US005999771A

United States Patent [19]

Wakihara

[11] Patent Number: 5,999,771

[45] Date of Patent: Dec. 7, 1999

[54] ELECTROPHOTOGRAPHIC APPARATUS WITH REMOVABLE PHOTOSENSITIVE DRUM

[75] Inventor: Junji Wakihara, Kato-gun, Japan

[73] Assignee: Fujitsu Limited, Kawasaki, Japan

[21] Appl. No.: 09/161,834

[22] Filed: Sep. 29, 1998

[30] Foreign Application Priority Data

Mar. 19, 1998 [JP] Japan ..... 10-071023

[51] Int. Cl.[6] ..... G03G 15/00

[52] U.S. Cl. ..... 399/117

[58] Field of Search ..... 399/110, 113, 399/116, 117, 118, 119; 347/138, 152, 170

[56] References Cited

U.S. PATENT DOCUMENTS

| | | | |
|---|---|---|---|
| 3,490,841 | 1/1970 | Cely, Jr. et al. | 399/110 |
| 3,667,840 | 6/1972 | Engel et al. | 399/110 |
| 3,689,146 | 9/1972 | Ito et al. | 399/110 |
| 3,981,272 | 9/1976 | Smith et al. | 399/110 |
| 4,056,315 | 11/1977 | Ariyama et al. | 399/249 |
| 4,131,359 | 12/1978 | Honda | 399/123 |
| 4,134,669 | 1/1979 | Reitner | 492/15 |
| 4,326,793 | 4/1982 | Buholtz | 384/546 |
| 4,922,297 | 5/1990 | Kondo | 399/117 |

*Primary Examiner*—Joan Pendegrass
*Attorney, Agent, or Firm*—Armstrong, Westerman, Hattori, McLeland & Naughton

[57] ABSTRACT

An electrophotographic apparatus is provided which includes a photosensitive drum, and a shaft for externally supporting the drum. The drum is removable from and mountable onto the shaft in a sliding manner. The apparatus also includes a guide rod releasably connected to the shaft. When the guide rod is connected to the shaft, the user can guide the drum along the rod both in removing the drum from the shaft and in mounting the drum onto the shaft. Further, the apparatus includes a stopper supported by the shaft. The stopper is arranged to project outwardly of the shaft for coming into engagement with the drum when the guide rod is not connected to the shaft. When the guide rod is connected to the shaft, the stopper retreats into the shaft for avoiding engagement with the drum.

18 Claims, 34 Drawing Sheets

ELECTROPHOTOGRAPHIC APPARATUS WITH REMOVABLE PHOTOSENSITIVE DRUM

BACKGROUND OF THE INVENTION

1. Field of the Invention

The present invention relates to an electrophotographic apparatus used for printing images on a recording paper sheet. In particular, the present invention relates to an electrophotographic apparatus incorporating a photosensitive drum.

2. Description of the Related Art

FIG. 34 of the accompanying drawings shows an example of conventional electrophotographic apparatus. The illustrated apparatus includes a photosensitive drum 1*e* and a plurality of peripheral devices arranged adjacent to the photosensitive drum. The peripheral devices may be a charging unit 8*e,* an exposing unit 3*e,* a developing unit 4*e,* a sheet transferring unit 5*e,* and a cleaning unit 6*e*. The charging unit 8*e* is used for charging the cylindrical outer surface of the drum 1*e*. The exposing unit 3*e* irradiates the charged outer surface of the drum with light so that a charged pattern corresponding to a selected image to be printed is formed on the outer surface of the drum 1*e*. The developing unit 4*e* supplies toner to the outer surface of the drum 1*e* for making visible (developing) the charged pattern of the selected image. The sheet transferring unit 5*e* serves to feed recording paper sheets 98 from a paper supply portion 99. Each of the recording paper sheets is brought into contact with the outer surface of the drum 1*e,* so that the toner-developed image (hereinafter, simply called "toner image") is transferred onto the recording paper sheet. The cleaning unit 6*e* serves to scrape remaining toner off the outer surface of the drum 1*e*. The recording paper sheet 98 carrying the toner image is sent to a fixing unit 97 for undergoing heat treatment so that the toner image is fixed to the paper sheet 98. Thereafter, the paper sheet 98 is forwarded to a recorded sheet stocker 96.

As is known, after the electrophotographic apparatus has been repeatedly used for a certain period of time, the outer surface of the drum may become difficult to be properly charged. In such an instance, the user may need to replace the photosensitive drum 1*e* with a new one.

For facilitating the replacement of the photosensitive drum 1*e,* conventionally, the drum is releasably mounted on a rotating shaft 2*e*. Specifically, referring to FIG. 35, the shaft 2*e* has a first end 2*f* and a second end 2*g* opposite to the first end. The first end 2*f* is rotatably supported by a cover member 7*e* via a bearing 80*e* fixed to the cover member. The cover member is releasably attached to a stationary chassis 9*e*. The first end 2*f* is screwed into a nut 95 for preventing the drum 1*e* from unduly coming off the shaft 2*e*. The second end 2*g* is supported by a fixing member 9*f* via a pair of bearings 81*e*.

With such an arrangement, the drum 1*e* is easily removed from the shaft 2*e* in the following manner. First, as shown in FIG. 36, the cover member 7*e* is detached from the chassis 9*e*. At this stage, the shaft 2*e* is supported only at the second end 2*g* by the two bearings 81*e*. Then, after the nut 95 is removed from the shaft 2*e,* the user can easily remove the drum 1*e* from the shaft 2*e* via the first end 2*f*. Thereafter, a new photosensitive drum is installed on the shaft 2*e* in the reversed manner.

In replacing the photosensitive drum 1*e* with a new one, the user should be careful enough not to cause those photosensitive drums (the old and new ones) to come into contact with the peripheral devices. If such contact occurs, the photosensitive drums (especially the outer surface of the new drum) and/or the peripheral devices may unfavorably be damaged, rendering the apparatus unable to perform proper image printing.

For avoiding the above problem, the peripheral devices of the conventional apparatus are arranged to be movable relative to the photosensitive drum. Specifically, the peripheral devices can be brought into two states, i.e., a set state where the peripheral units are positioned close to the outer surface of the drum 1*e,* and a release state where the peripheral units are sufficiently spaced away from the drum. With such an arrangement, by bringing the peripheral devices into the release states, it is possible for the user to perform the drum replacement without causing the drums and the peripheral devices to be damaged.

For more reliable protection of the drums and the peripheral devices, use may additionally be made of a guide rod 89*e* connected to the shaft 2*e* in longitudinal alignment therewith, as shown in FIG. 37. Such an arrangement is advantageous in that the drum 1*e* is moved only in its axial direction but not in its radial direction when removed from or installed onto the shaft 2*e*. As a result, unfavorable contact between the photosensitive drum and the peripheral devices can be avoided.

However, the conventional electrophotographic apparatus has been found still disadvantageous in the following points.

Specifically, with the nut 95 detached from the shaft 2*e* (see FIG. 36), nothing can stop the drum 1*e* from being removed from the shaft 2*e*. Thus, even though the guide rod 89*e* is ready for use, the user may not utilize it because he finds it troublesome or time-consuming to connect the rod to the shaft, or because he does not know how to use the guide rod.

Another disadvantage of the conventional apparatus is that the user may fail to remember fixing the positioning nut 95 to the shaft 2*e* after a new photosensitive drum is installed. In such an instance, the drum may unfavorably be displaced along the shaft 2*e* upon operation of the apparatus, which may cause damage to the drum and the peripheral devices.

Still further, in the conventional apparatus, the user may improperly try to remove the drum 1*e* from the shaft 2*e* before the peripheral devices are brought into the release states. In such an instance, since the peripheral devices are held close to or in contact with the outer surface of the drum 1*e,* the outer surface of the drum and/or the peripheral devices may be unfavorably damaged.

SUMMARY OF THE INVENTION

It is, therefore, an object of the present invention to provide an electrophotographic apparatus capable of overcoming the disadvantage described above.

According to a first aspect of the present invention, there is provided an electrophotographic apparatus comprising: a photosensitive drum; a shaft for externally supporting the drum, the drum being removable from and mountable onto the shaft in a sliding manner; a guide rod releasably connected to the shaft for guiding the drum both in removing the drum from the shaft and in mounting the drum onto the shaft; a stopper supported by the shaft; wherein the stopper is arranged to project outwardly of the shaft for coming into engagement with the drum when the guide rod is not connected to the shaft, the stopper also being arranged to retreat into the shaft for avoiding engagement with the drum when the guide rod is connected to the shaft.

With such an arrangement, when the guide rod is connected to the shaft, the stopper retreats into the shaft so that it does not interfere with the photosensitive drum. Thus, while allowing the drum to be guided by the guide rod, the user can remove the drum from the shaft (as well as install a new drum on the shaft). On the other hand, when the guide rod is not connected to the shaft, the stopper projects outwardly of the shaft to come into contact with the drum. In this instance, the user cannot remove the drum from the shaft or install a new one on the shaft. In summary, according to the present invention, the user needs to attach the guide rod to the shaft for moving (both removing and installing) the drum along the shaft. Thus, it is possible to prevent the photosensitive drum and/or the peripheral units from being damaged.

Further, with the above arrangement, the stopper is arranged to automatically project outwardly of the shaft when the guide rod is detached from the shaft. Thus, according to the present invention, there is no need to use a nut for positioning the photosensitive drum relative to the shaft.

According to a preferred embodiment of the present invention, the electrophotographic apparatus further comprises: a movable member arranged to reciprocate longitudinally of the shaft, the movable member being associated with the stopper; a spring connected to the movable member for applying an urging force to the movable member in a predetermined direction; a hollow portion formed at an end of the shaft and having an opening for allowing insertion of the guide rod, the hollow portion serving to accommodate the movable member and the spring; and a slit formed in the shaft, the slit communicating with the hollow portion; wherein the stopper is rotatably supported by the shaft, the stopper being caused to project outwardly of the shaft through the slit when the movable member is displaced toward the opening of the hollow portion, the stopper being caused to retreat into the shaft through the slit when the movable member is displaced away from the opening of the hollow potion.

With such an arrangement, it is possible to cause the stopper to project from and retreat into the shaft with the use of a simple mechanism including the movable member and the spring connected to the movable member.

Advantageously, the stopper is arranged to keep projecting outwardly of the shaft when a force directed longitudinally of the shaft is applied to a projecting portion of the stopper.

With such an arrangement, even when the user tries to pull out the drum from the shaft without connecting the guide rod to the shaft, the stopper will not retreat into the shaft. Such a feature is advantageous in projecting the drum and the peripheral units from getting damaged.

According to a second aspect of the present invention, there is provided an electrophotographic apparatus comprising: a photosensitive drum having an end surface; a cover member for protection of the drum; fixing means for releasably holding the cover member in facing relation to the end surface of the drum; a shaft for externally supporting the drum, the shaft has a first end and a second end opposite to the first end, the drum bing removable from and mountable onto the shaft in a sliding manner via the first end of the shaft when the cover member is detached from the fixing means; a presser member supported by the cover member, the presser member being arranged to come into contact with the end surface of the drum when the cover member is brought to the fixing means, so that the presser member moves the drum toward the second end of the shaft; and a presser member operation mechanism for causing the presser member to move away from the drum when cover member is fixed to the fixing means.

With such an arrangement, when the cover member is brought to the fixing means after a new photosensitive drum is installed on the shaft, the presser member can move the newly installed drum toward the second end of the shaft. Thus, even when the new drum is not properly positioned on the shaft at first, the drum will be brought into a correct position when the cover member is about to be attached to the fixing means. Thereafter, when the cover member is fixed to the fixing means, the presser member is caused to move away from the drum to be spaced therefrom. At this stage, the drum is properly rotated without being interfered with by the presser member.

Preferably, the electrophotographic apparatus further comprises a cover member operation mechanism for selectively bringing the cover member into a set state where the cover member is fixed to the fixing means, and a release state where the cover member is releasable from the fixing means, wherein the presser member operation mechanism serves to move the presser member away from the cover member when the cover member is brought into the release state, while also serving to move the presser member toward the cover member when the cover is brought into the set state.

The cover member operation mechanism may include an operation lever movable between a first position and a second position, and claws supported by the cover member, the claws being arranged to come into engagement with the fixing means when the operation lever is brought to the first position, while also arranged to come out of engagement with the fixing means when the operation lever is brought to the second position, the presser member operation mechanism being arranged to move the presser member toward the cover member when the operation lever is brought to the first position, while also arranged to move the presser member away from the cover member when the operation lever is brought to the second position.

According to a third aspect of the present invention, there is provided an electrophotographic apparatus comprising: a photosensitive drum having a cylindrical outer surface and an end surface; a peripheral unit arranged adjacent to the drum, the peripheral unit being selectively brought into a set state where the unit being selectively brought into a set state where the unit is held closer to the outer surface of the drum and a release state where the unit is held farther from the outer surface of the drum than in the set state; a cover member releasably held at a setting position in facing relation to the end surface of the drum; a shaft for externally supporting the drum, the drum being removable from and mountable onto the shaft when the cover member is removed from the setting position; and a cover member restricting mechanism arranged to allow the cover member to be removed from the setting position when the peripheral unit is held in the release state, the restricting mechanism being also arranged to prevent the cover member from being removed from the setting position when the peripheral unit is held in the set state.

With such an arrangement, when the peripheral unit is in the release state, the cover member can be taken away from near the photosensitive drum, thereby enabling the user to remove the photosensitive drum from the shaft. On the other hand, when the peripheral unit is in the set state, displacement of the cover member is restricted by the cover member restricting mechanism. Thus, the cover member cannot be taken away from near the photosensitive drum. As a result, the user cannot remove the drum from the shaft. In this way, according to the present invention, the user needs to bring the peripheral unit into the release state for removing the drum from the shaft. Thus, the photosensitive drum will not be damaged by the peripheral unit when removed from the shaft.

According to a preferred embodiment, the peripheral unit may comprise a developing unit, while the cover member restricting mechanism may comprise an engaging portion provided on the developing unit. The engaging portion is arranged to come into engagement with the cover member when the developing unit is held in the set state. The engaging portion is also arranged to come out of engagement with the cover member when the developing unit is held in the release state.

According to another preferred embodiment, the electrophotographic apparatus further comprises sliding rails for pulling the developing unit out of the electrophotographic apparatus, wherein the developing unit is spaced from the sliding rails when the developing unit is held in the set state, the developing unit being supported by the sliding rails in contact therewith when the developing unit is held in the release state.

With such an arrangement, the user cannot pull out the developing unit by using the sliding rails unless he brings the developing unit into the release state. Thus, according to the present invention, it is possible to prevent the developing unit and the photosensitive drum from being damaged by each other when the developing unit is replaced with a new one.

The peripheral unit may comprise an exposing unit, while the cover member restricting mechanism may comprise an engaging portion provided on the exposing unit. The engaging portion of the exposing unit is arranged to come into engagement with the cover member when the exposing unit is held in the set state. The engaging portion of the exposing unit is also arranged to come out of engagement with the cover member when the exposing unit is held in the release state.

The peripheral unit may comprise a sheet transferring unit, while the cover member restricting mechanism may comprise an engaging portion provided on the sheet transferring unit. The engaging portion of the sheet transferring unit is arranged to come into engagement with the cover member when the sheet transferring unit is held in the set state. The engaging portion of the sheet transferring unit is also arranged to come out of engagement with the cover member when the sheet transferring unit is held in the release state.

Further, the peripheral unit may comprise a cleaning unit provided with a cleaning blade. The cleaning blade is held in contact with the outer surface of the drum when the cleaning unit is in the set state, while the cleaning blade is held out of contact with the outer surface of the drum when the cleaning unit is in the release state. The cover member restricting mechanism may comprise a movable engaging member which comes into engagement with the cover member when the cleaning unit is held in the set state. The movable engaging member is arranged to come out of engagement with the cover member when the cleaning unit is held in the release state.

According to another preferred embodiment, the electrophotographic apparatus may further comprise a peripheral unit restricting mechanism arranged to allow the peripheral unit to be brought into either one of the set and release states when the cover member is held in the setting position. The peripheral unit restricting mechanism is also arranged to cause the peripheral unit to be fixed in the release state when the cover member is removed from the setting position.

With such an arrangement, since the peripheral unit is fixed in the release state when the cover member is removed from the setting position, it is possible to prevent the user from improperly installing a new photosensitive drum on the shaft with the peripheral unit held in the set state.

According to another preferred embodiment, the electrophotographic apparatus may further comprise fixing means for holding the cover member in the setting position, and a cover member operation lever for selectively bringing the cover member into a set state where the cover member is fixed to the fixing means and a release state where the cover member is freed from engagement with the fixing means.

The electrophotographic apparatus may further comprise a peripheral unit operation lever for selectively bringing the peripheral unit into either one of the set and release states, wherein the peripheral unit comprises a developing unit. The peripheral unit restricting mechanism is arranged to restrict operation of the peripheral unit operation lever when the cover member is brought into the release state.

The peripheral unit may comprise a cleaning unit having a cleaning blade which is selectively brought into the set state where the cleaning blade is held in contact with the outer surface of the drum and the release state where the cleaning blade is spaced from the outer surface of the drum.

The peripheral unit may comprise an exposing unit arranged to pivot for approaching and moving away from the outer surface of the drum. The peripheral unit restricting mechanism is arranged to allow the exposing unit to perform the pivotal movement when the cover member is attached to the fixing means. The peripheral unit restricting mechanism is also arranged to prevent the exposing unit from approaching the outer surface of the drum beyond a predetermined extent when the cover member is detached from the fixing means.

The peripheral unit may comprise a sheet transferring unit arranged to pivot for approaching and moving away from the outer surface of the drum. The peripheral unit restricting mechanism is arranged to allow the sheet transferring unit to perform the pivotal movement when the cover member is brought into the set state. The peripheral unit restricting mechanism is also arranged to restrict the pivotal movement of the sheet transferring unit when the cover member is brought into the release state.

Other features and advantages of the present invention should become clear from the detailed description to be made hereinafter referring to the accompanied drawings.

DETAILED DESCRIPTION OF THE PREFERRED EMBODIMENT

The preferred embodiments of the present invention will be specifically described below with reference to the accompanying drawings.

Figure 1:
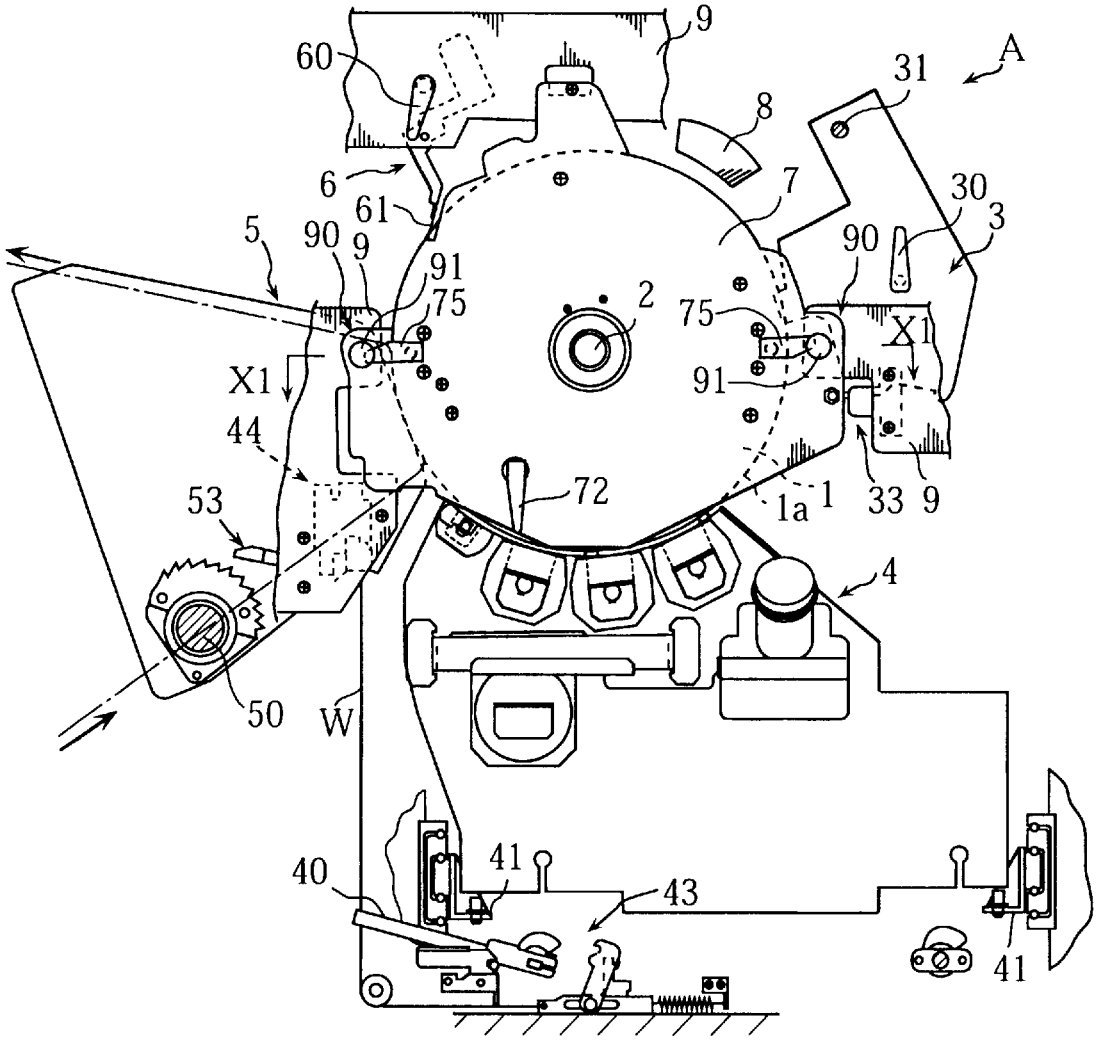
FIG. 1 is a front view schematically showing an example of electrophotographic apparatus embodying the present invention.
Figure 2:
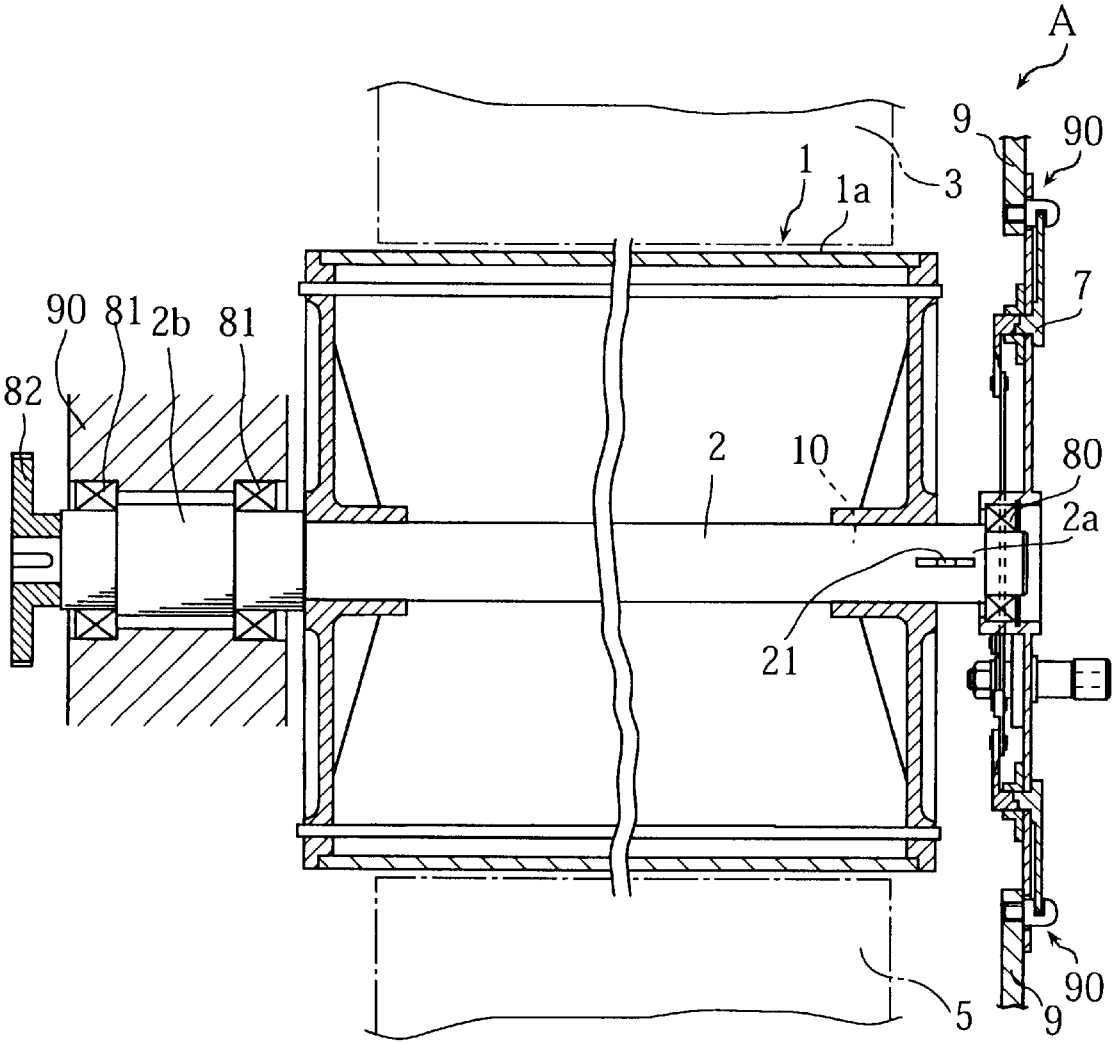
FIG. 2 is a sectional view taken along lines X1—X1 in FIG. 1.

FIG. 1 is a front view schematically showing an example of electrophotographic apparatus A according to the present invention. FIG. 2 is a sectional view taken along lines X1—X1 in FIG. 1.

As shown in FIG. 1, the electrophotographic apparatus A includes a photosensitive drum 1, a shaft 2, and other units arranged around the drum 1. Among these units are a charging unit 8, an exposing unit 3, a developing unit 4, a sheet transferring unit 5 and a cleaning unit 6. The apparatus A also includes a cover member 7. Though not shown, the electrophotographic apparatus A is provided with a housing for accommodating the above-mentioned components and units. Further, the apparatus A includes a stationary chassis 9 for supporting certain components, units and so on.

As shown in FIG. 2, the photosensitive drum 1 is generally cylindrical and formed with a central through-hole 10 for allowing insertion of the shaft 2. In the assembled state, the drum 1 is externally supported by the shaft 2 which extends through the drum 1 in the axial direction of the drum. The drum 1 has a photosensitive outer surface 1*a* suitably arranged for performing electrophotographic processing such as generation of electrostatic latent images.

The shaft 2 is rotatable about its axis. Thus, the drum 1 carried by the shaft 2 is rotated together with the shaft. Like the conventional shaft 2*e* described with reference to FIGS. 34–37, the shaft 2 of the present invention can also be supported in a cantilever manner. Specifically, the shaft 2 has a first end 2*a* and a second end 2*b* opposite to the first end. When the cover member 7 is attached to fixing means 90 of the chassis 9, the first end 2*a* of the shaft 2 is supported by a bearing 80 fixed to the cover member 7. The second end 2*b* of the shaft 2 is supported by a pair of bearings 81 fixed to a stationary support 90*a* of the apparatus A. With such an arrangement, even after the cover member 7 is detached from the fixing means 90, it is possible to hold the shaft 2 in the horizontally extending position, with only the second end 2*b* supported by the pair of bearings 81. A gear 82 is fixed to the second end 2*b* of the shaft 2, so that driving force to rotate the shaft 2 is transmitted to the shaft from a suitable motor (not shown) via the gear 82.

Figure 3:
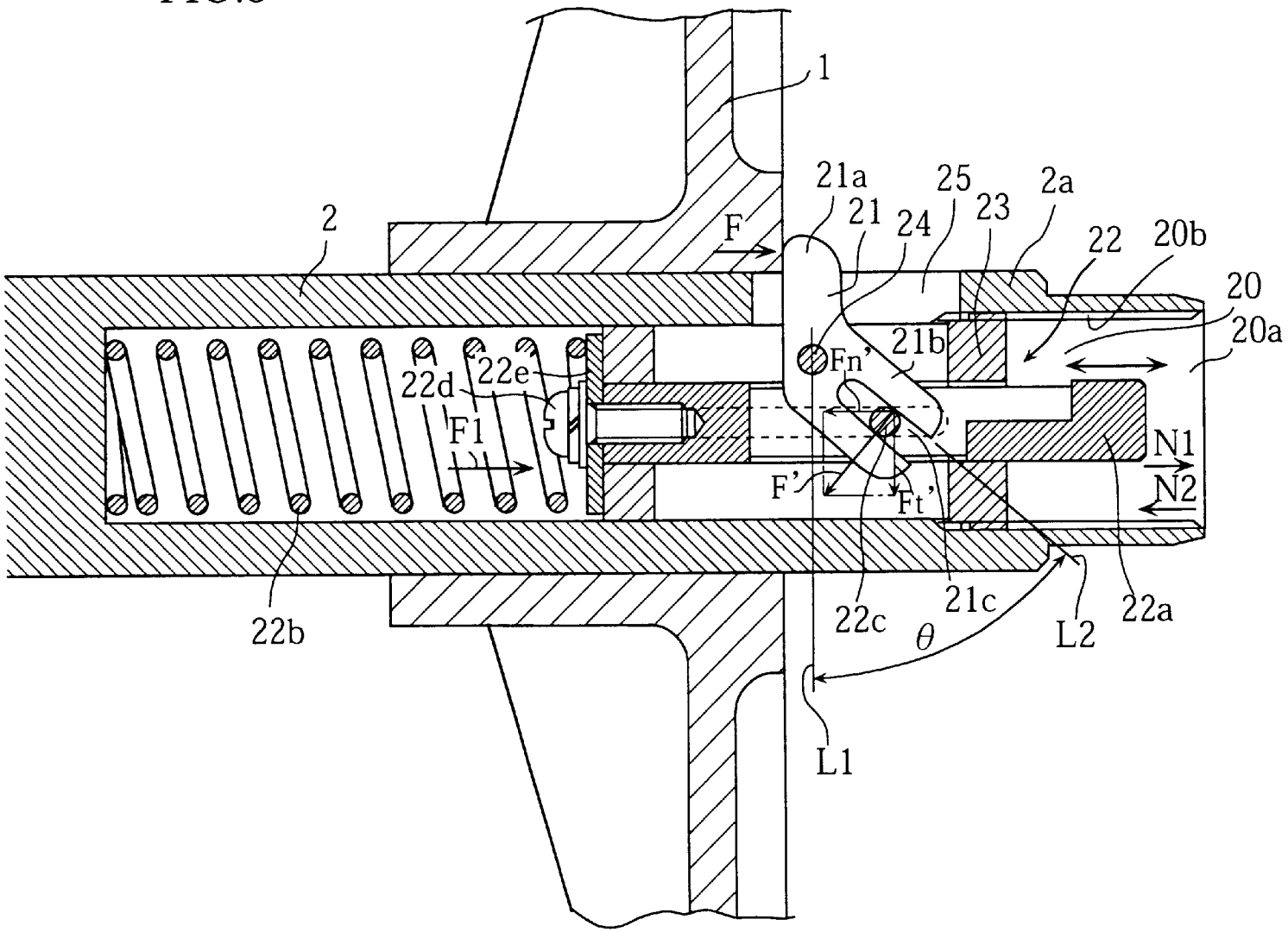
FIG. 3 is an enlarged sectional view showing principal arrangements of a shaft.
Figure 4:
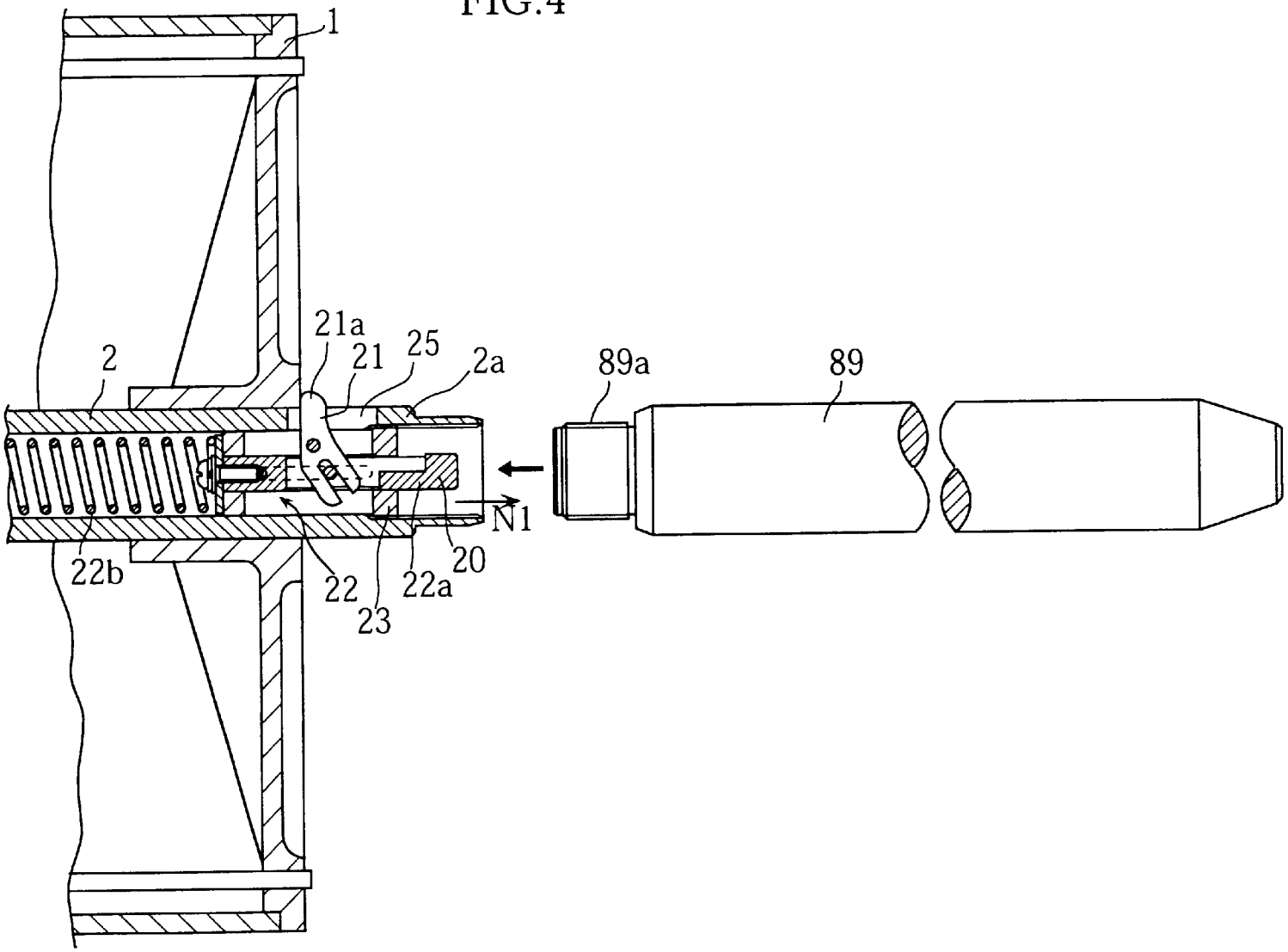
FIGS. 4–5 illustrate how a photosensitive drum is removed from the shaft.
Figure 5:
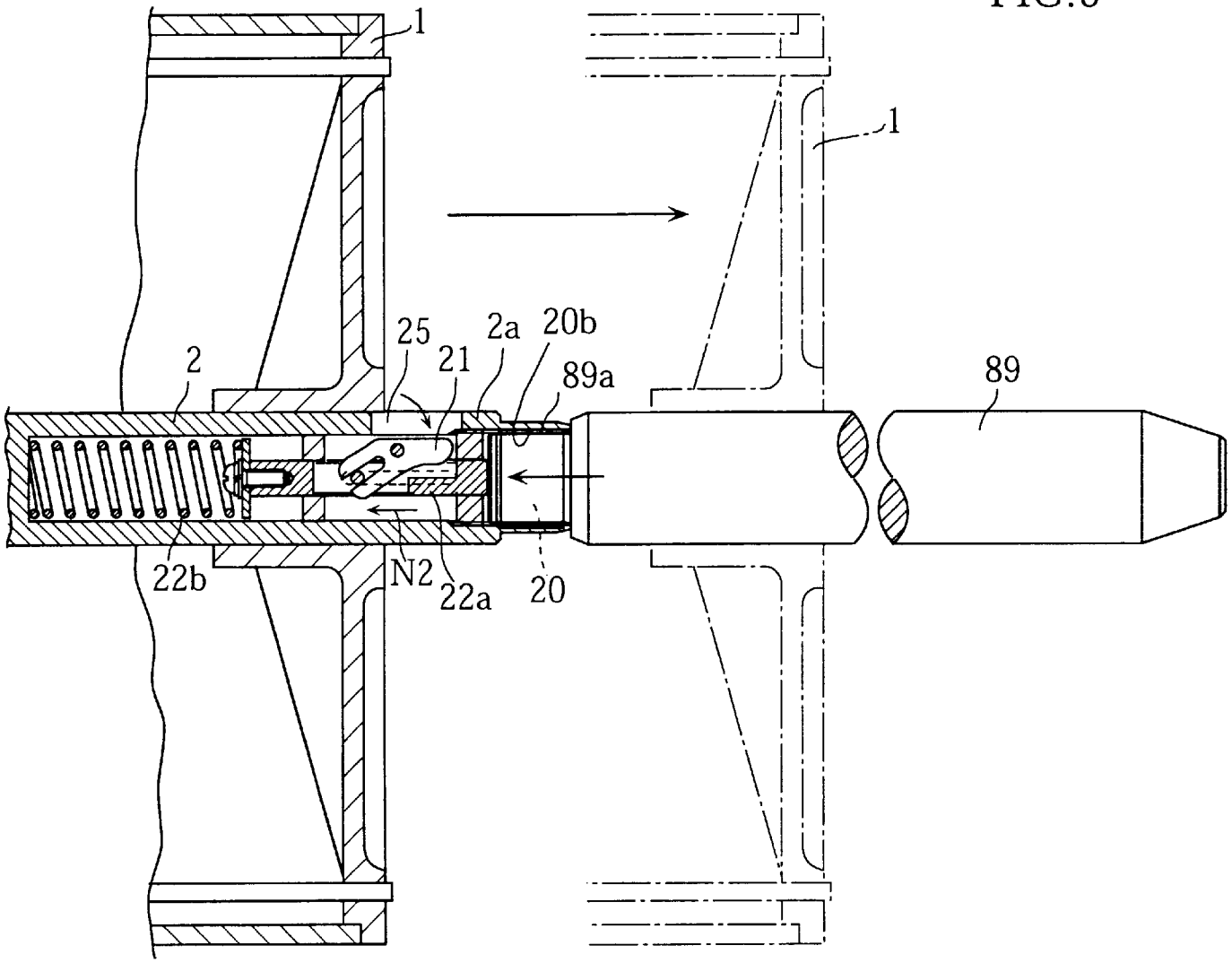
Figure 6:
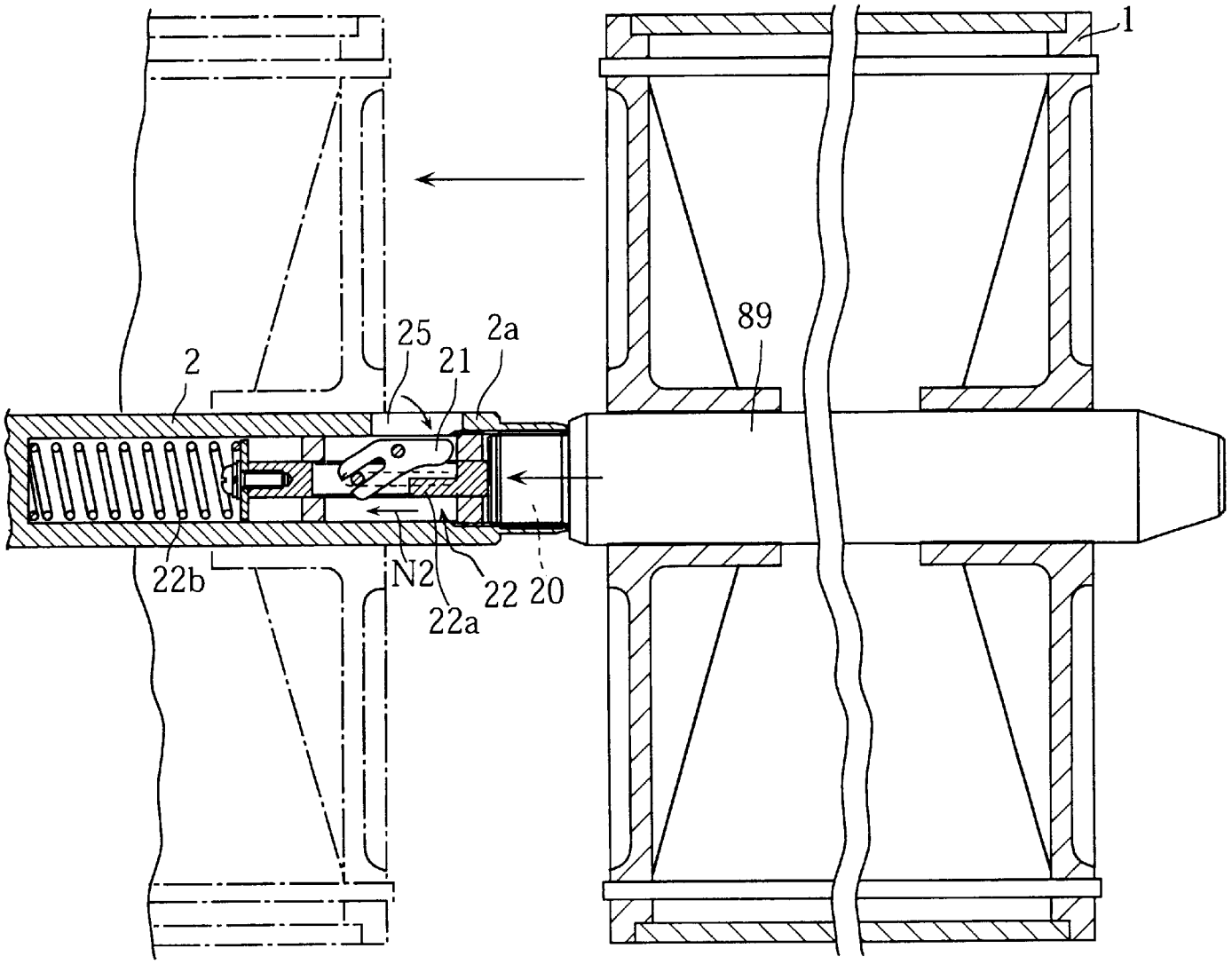
FIG. 6 illustrates how the photosensitive drum is installed on the shaft.

FIG. 3 is an enlarged sectional view showing principal parts of the shaft 2. FIGS. 4–6 illustrate how the drum 2 is detached from the shaft 2 and brought back into engagement with the same shaft.

As shown in FIG. 3, the shaft 2 is provided at the first end 2*a* with a hollow portion 20 arranged to accommodate a stopper 21 and an operation mechanism 22 for operating the stopper. The extremity of the first end 2*a* of the shaft 2 is formed with an opening 20*a* communicating with the hollow portion 20. As shown in FIGS. 4–6, a guide rod 89 has a externally threaded end 89*a* to be screwed into the hollow portion 20. The hollow portion 20 is provided with an internally threaded area 20*b* coming into engagement with the threaded end 89*a* of the guide rod 89.

As best shown in FIG. 3, the stopper 21 has a non-linear configuration. The stopper 21 is supported by a holder 23 for rotational movement about a shaft 24 of the holder. The first end 2*a* of the shaft 2 is formed with a slit 25 communicating with the hollow portion 20. Via the slit 25, a first end 21*a* of the stopper 21 can project outward from the shaft 2. The holder 23 has an externally threaded portion coming into engagement with the internally threaded area 20*b*, whereby the holder 23 is positionally fixed in the hollow portion 20.

The stopper operation mechanism 22 includes a reciprocative rod 22*a* and a spring 22*b* accommodated in the hollow portion 20. The reciprocative rod 22*a* is supported by the holder 23 for sliding movement in the axial direction of the shaft 2. The reciprocative rod 22*a* is provided with a pin 22*c* projecting through a groove 21*c* of the stopper 21. The groove 21*c,* as is shown in FIG. 3, is formed in a second end 21*b* of the stopper 21. With such an arrangement, when the reciprocative rod 22*a* is moved axially of the shaft 2, the stopper 21 is caused to pivot about the shaft 24. Specifically, when the reciprocative rod 22*a* is moved toward the opening 20*a* (in a direction shown by an arrow N1), the stopper 21 takes positions where the first end 21*a* of the stopper projects outward from the shaft 2 (FIGS. 3 and 4). Conversely, when the reciprocative rod 22*a* is moved away from the opening 20*a* (in a direction shown by an arrow N2), the first end 21*a* of the stopper 21 retreats into shaft 2 via the slit 25 (FIGS. 5 and 6).

The actuation mechanism 22 is arranged so that the stopper 21 will not retreat into the slit 25 even when an axial force F (see FIG. 3) is applied to the first end 21*a* of the stopper. As shown in FIG. 3, the groove 21*c* of the stopper 21 extends along a line L2 which intersects a vertical line L1 at a predetermined angle θ. Here, the angle θ is rendered greater than 45 degrees. With such an arrangement, when the axial force F is applied to the first end 21*a* of the stopper 21, the force F' (which is applied to an inner surface of the groove 21*c* by the pin 22*c*) will have a horizontal component Fn' smaller than a vertical component Ft' of the force F'. Therefore, even when the force F is applied, the reciprocative rod 22*a* will not be moved.

The spring 22*b* applies a force F1 to the reciprocative rod 22*a,* so that the reciprocative rod is constantly urged in the N1-direction. Specifically, a ring plate 22*e* is fixed to an end of the reciprocative rod 22*a* by a screw 22*d.* The spring 22*b* has an end coming into contact with the ring plate 22*e,* whereby the force F1 is applied to the reciprocative rod.

In a normal assembled state of the electrophotographic apparatus A, as shown in FIGS. 3 and 4, the reciprocative rod 22*a* is displaced to the right (i.e., in the N1-direction) due to the urging force F1 of the spring 22*b.* As a result, the first end 21*a* of the stopper 21 is caused to project outwardly of the first end 2*a* of the shaft 2. In this state, since the stopper 21 comes into contact with an end surface of the photosensitive drum 1, the photosensitive drum will not be unduly displaced in the N1-direction on the shaft 2.

For removing the photosensitive drum 1 from the shaft 2, first the cover member 7 needs to be detached from the fixing means 90. At this stage, however, the user still cannot remove the drum 1 from the shaft 2. For bringing the drum 1 into a removable condition, the user should connect the guide rod 89 to the shaft 2. With the guide rod 89 unconnected to the shaft 2, the first end 21*a* of the stopper 21 is held in contact with the photosensitive drum 1. As stated above, the first end 21*a* of the stopper 21 will not retreat into the slit 25 even the force F is applied by the drum 1. In this way, the stopper 21 serves to prevent the photosensitive drum 1 from being prematurely removed from the shaft 2.

When the guide rod 89 is inserted into the hollow portion 20 of the shaft 2, the reciprocative rod 22*a* comes into contact with the guide rod 89 and is moved by the rod in the N2-direction against the urging force F1 of the spring 22. As a result, the stopper 21 is caused to retreat into the slit 25 of the shaft 2. In this state, the photosensitive drum 1 is removed from the shaft 2. Here, it should be appreciated that the drum 1 to be removed is advantageously guided by the guide rod 89, as indicated by single-dot chain lines in FIG. 5. Thus, in removal from the shaft 2, the photosensitive drum 1 will not be unduly moved in radial directions thereof. Therefore, it is possible to reduce or even eliminate possibilities that the photosensitive drum 1 unduly comes into contact with the developing unit 4 or any other adjacent unit.

The stopper 21 is caused to constantly project outward from the shaft 2 when the reciprocative rod 22*a* does not receive any force form the guide rod 89 (in other words, when the guide rod 89 is not connected to the shaft 2). It follows that, once the drum 1 is removed from the shaft 2, the user cannot install the drum 1 on the shaft 2 when the guide rod 89 is not connected to the shaft 2. Thus, for installing the drum 1 on the shaft 2, the user needs to connect the guide rod 89 to the shaft 2 so that the stopper 21 will retreat into the slit 25. In summary, according to the present invention, the user needs to connect the guide rod 89 to the shaft 2 not only for removing the drum 1 from the shaft 2 but for installing the drum on the shaft.

Figure 7:
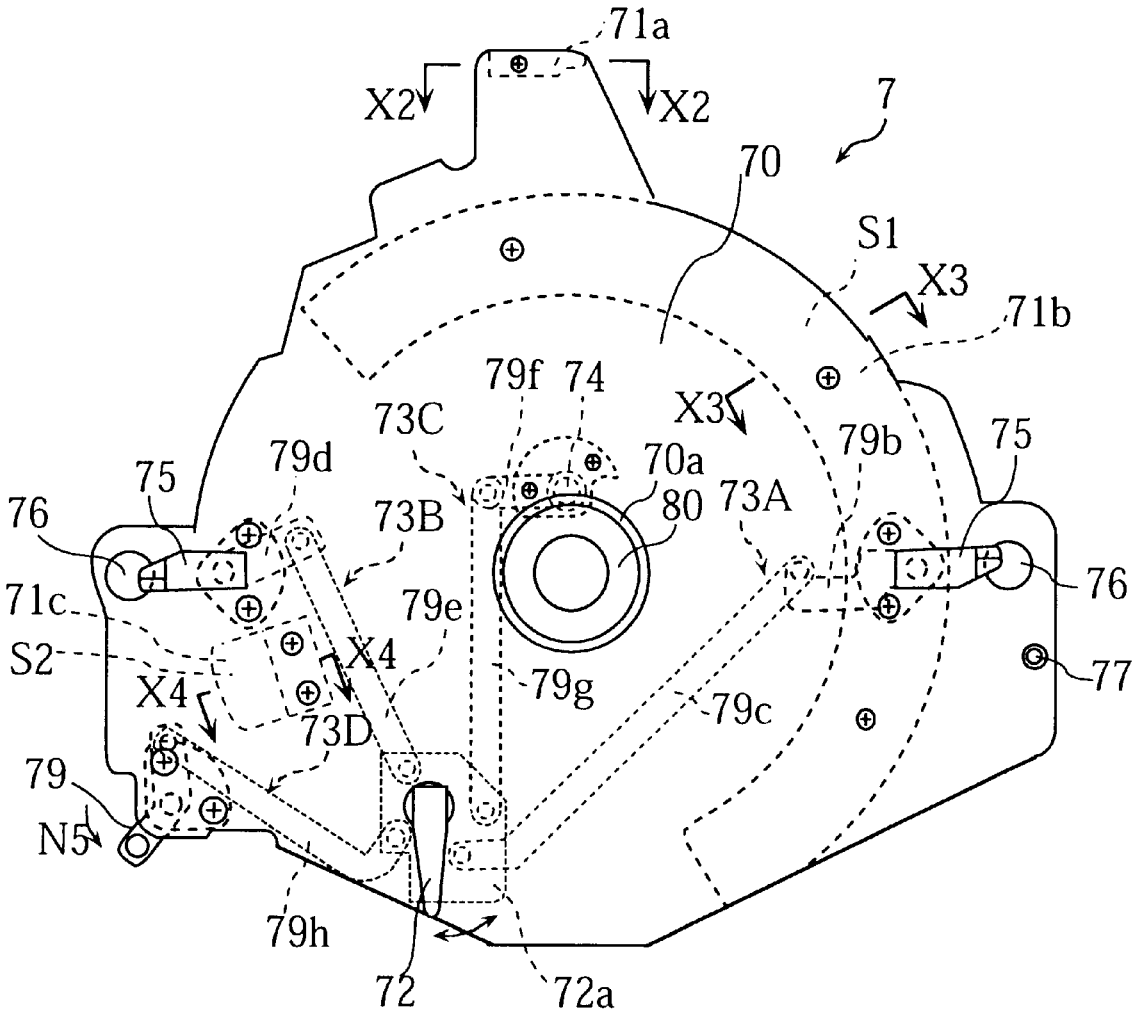
FIG. 7 is a front view showing a cover member brought into a set state.
Figure 8:
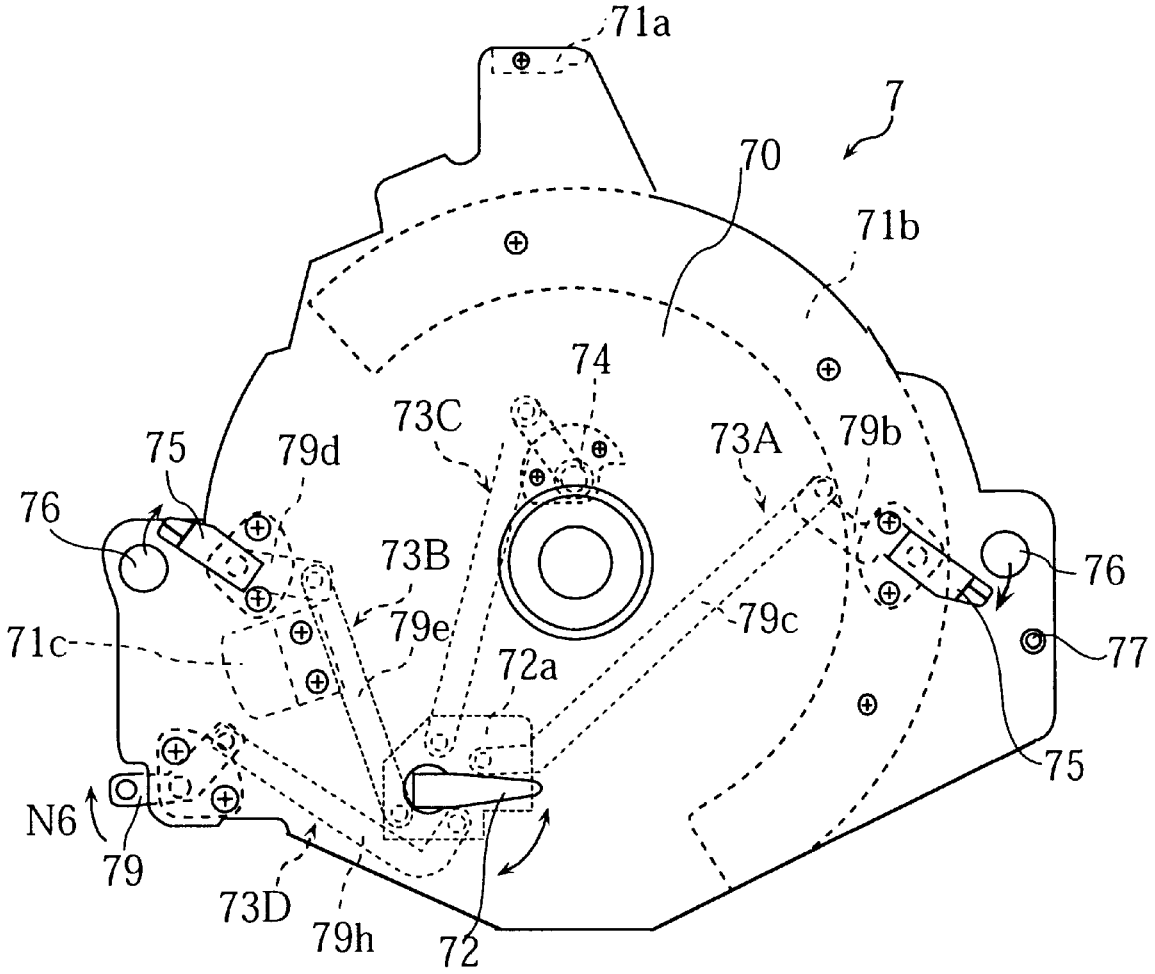
FIG. 8 is a front view showing the cover member brought into a release state.
Figure 9:
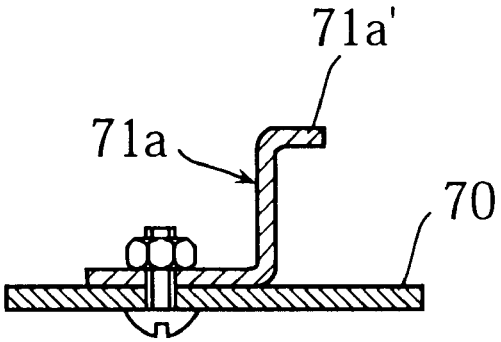
FIG. 9 is a sectional view taken along lines X2—X2 in FIG. 7.
Figure 10:
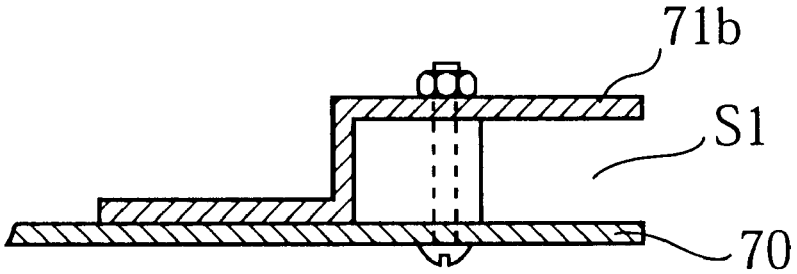
FIG. 10 is a sectional view taken along lines X3—X3 in FIG. 7.
Figure 11:
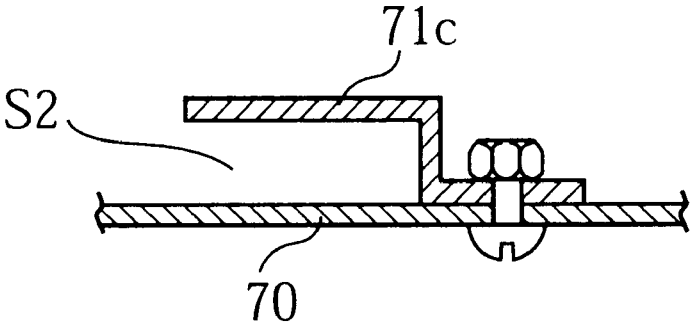
FIG. 11 is a sectional view taken along lines X4—X4 in FIG. 7.
Figure 12:
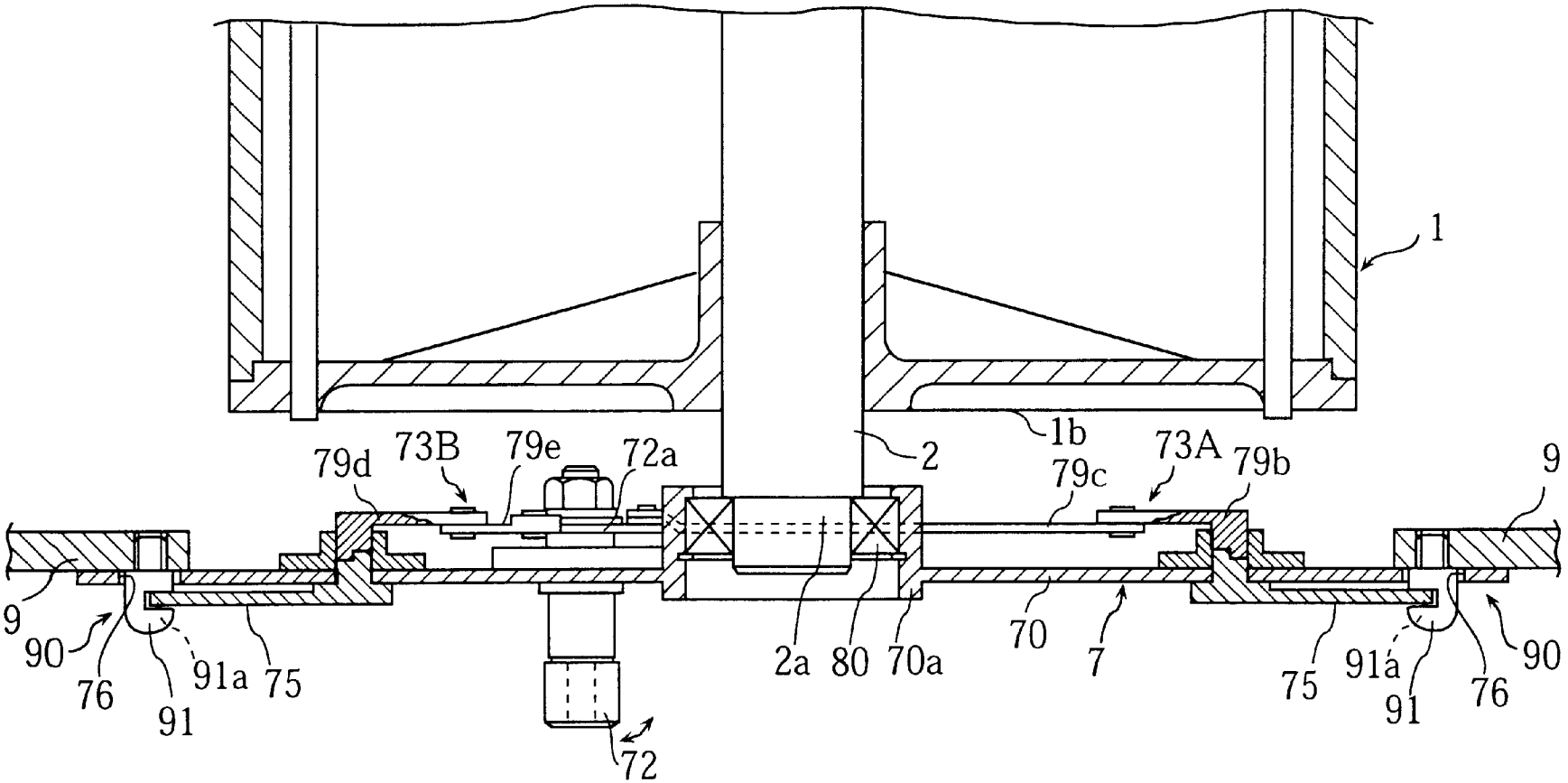
FIG. 12 is a sectional view showing a fixing arrangement of the cover member brought into the set state.
Figure 13:
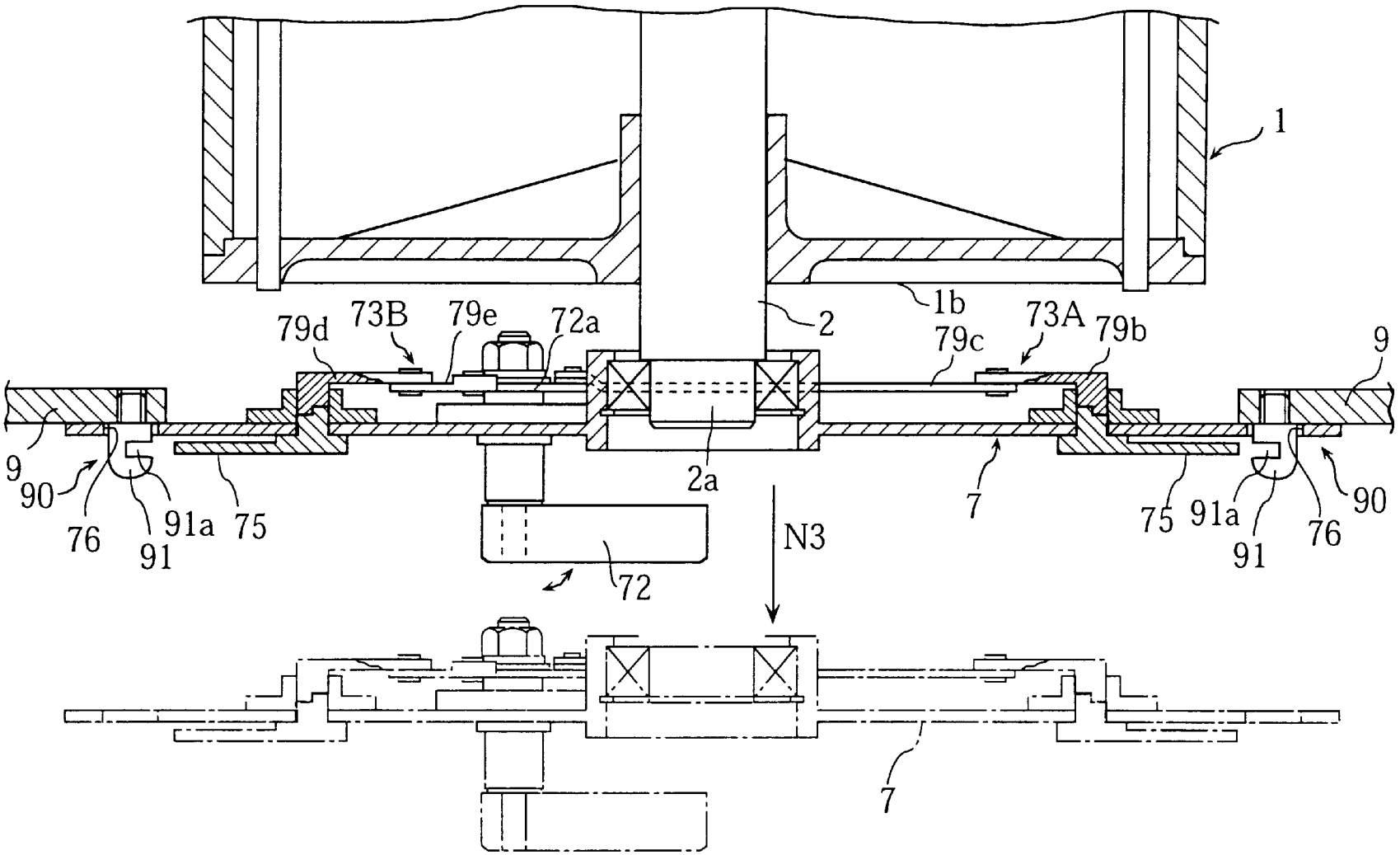
FIG. 13 is a sectional view showing a fixing arrangement of the cover member brought into the release state.
Figure 14:
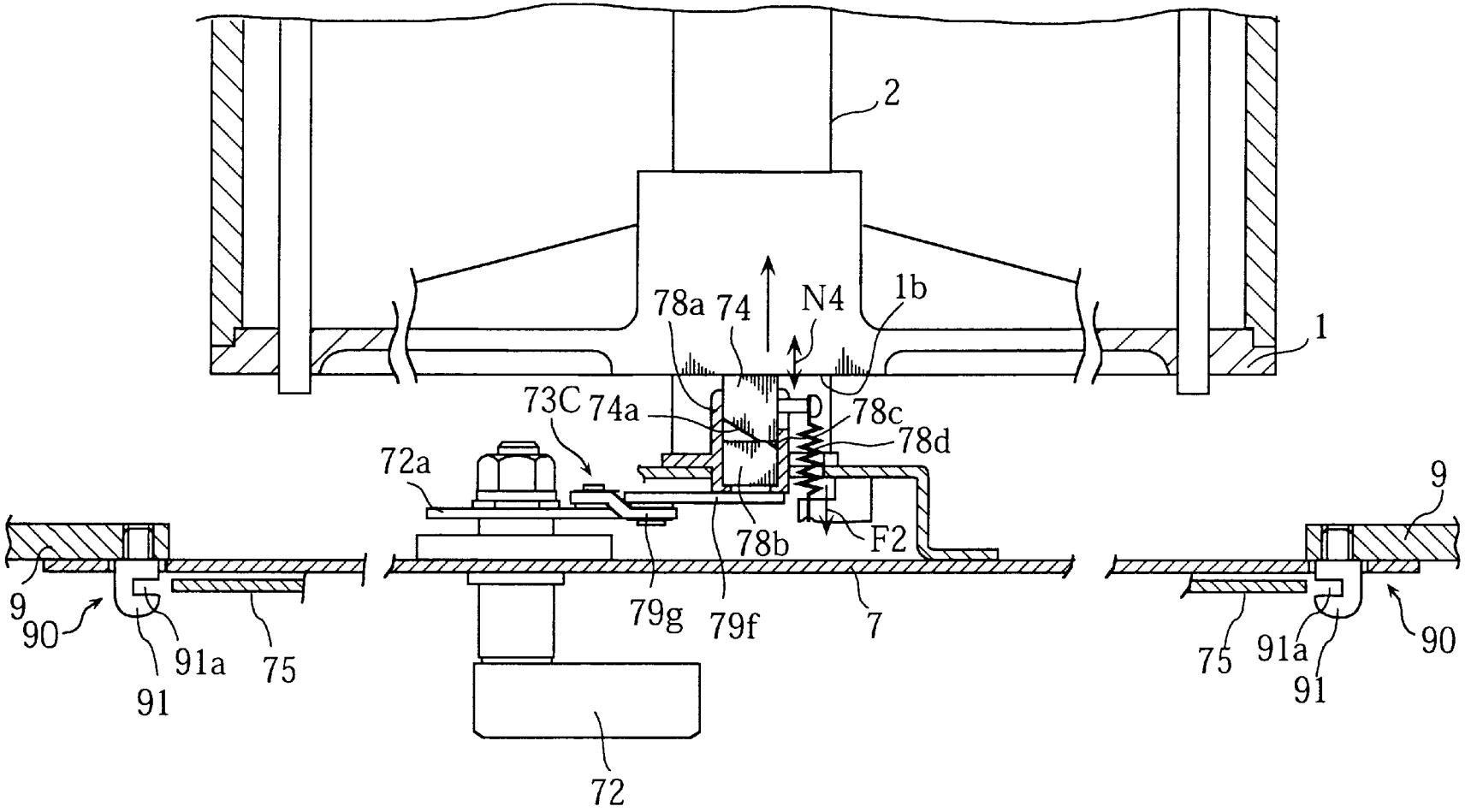
FIG. 14 is a sectional plan view showing the cover member which is about to be fixed.
Figure 15:
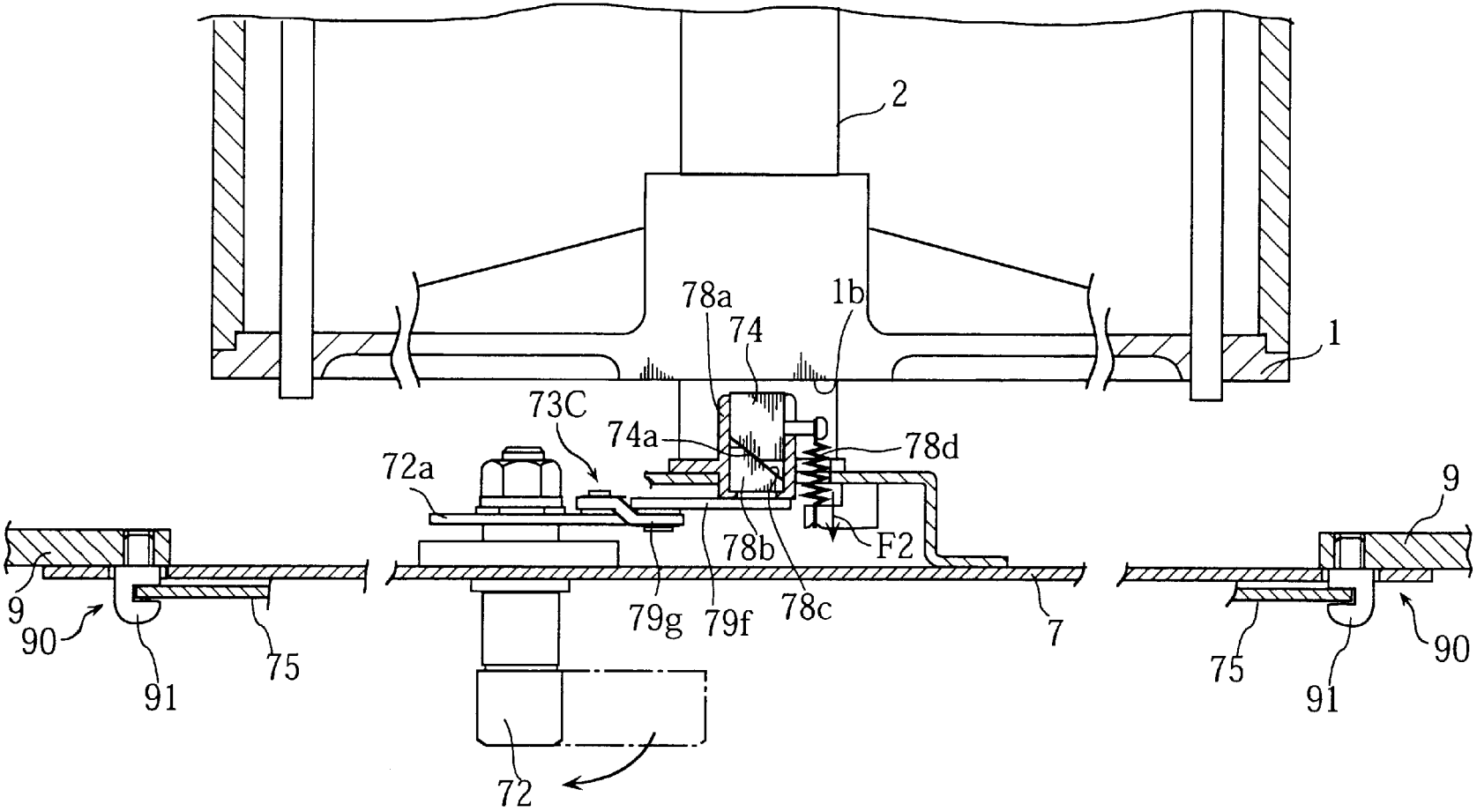
FIG. 15 is a sectional plan view showing the cover member fixed in position.

FIG. 7 is a front view showing the cover member 7 in a set state. FIG. 8 is a front view showing the cover member 7 in a release state. FIG. 9 is a sectional view taken along lines X2—X2 in FIG. 7. FIG. 10 is a sectional view taken along lines X3—X3 in FIG. 7. FIG. 11 is a sectional view taken along lines X4—X4 in FIG. 7. FIG. 12 is a sectional view showing principal parts of the fixing means for the cover member 7 held in the set state. FIG. 13 is a sectional view showing the principal parts of the fixing means for the cover member 7 held in the release state. FIG. 14 is a plan view showing the principal parts of the cover member 7 to be fixed. FIG. 15 is a plan view showing the principal parts of the cover member 7 installed in place.

Referring to FIG. 7, the cover member 7 includes a base plate 70 which is provided at a central portion with a cylindrical member 70*a* for holding the bearing 80. The base plate 70 may be prepared by pressworking a thin plate made of metal for example. The cover member 7 serves to support the first end 2*a* of the shaft 2 via the bearing 80, while protecting a side surface of the photosensitive drum 1. For the latter purpose, the plate 70 has suitable configuration and sizes.

The cover member is formed with a pair of bores 76. Further, the cover member 7 is provided with a pair of claws 75, an operation lever 72 (first operation lever), a movable plate 72*a* associated with the operation lever 72, a first link mechanism 73A, a second link mechanism 73B, a third link mechanism 73C, and a fourth link mechanism 73D. Each of the link mechanisms 73A–73D is associated with the movable plate 72*a*. The cover member 7 is also provided with a first engaging member 71*a,* a second engaging member 71*b,* a third engaging member 71*c* and a pin 77.

The first engaging member 71*a* is bolted to an upper portion of a reverse side of the base plate 70. As best shown in FIG. 9, the first engaging member 71*a* has an intermediate portion extending perpendicularly from the reverse side of the base plate 70, and an extremity 71*a,* extending from the intermediate portion in parallel to the base plate 70. As will be described later, the first engaging member 71*a* is arranged to work in association with the cleaning unit 6 for restricting freedom of the removing operation of the cover member 7. The second engaging member 71*b* has an arcuate, frontal configuration. As best shown in FIG. 10, the second engaging member 71*b* is bolted to the reverse side of the base plate 70 in a manner such that at least one space S1 is provided between the second engaging member 71*b* and the base plate 70. As will be described later, the second engaging member 71*b* is arranged to work in association with the developing unit 4 and the exposing unit 3 for restricting freedom of the removing operation of the cover member 7. As best shown in FIG. 11, the third engaging member 71*c* is bolted to the reverse side of the base plate 70 in a manner such that a space S2 is provided between the third engaging member 71*c* and the base plate 70. As will be described later, the third engaging member 71*c* is arranged to work in association with the sheet transferring unit 5 for restricting freedom of the removing operation of the cover member 7. The pin 77 projects from the reverse side of the base plate 70. As will be described with reference to FIGS. 25–29, the pin 77 is used for maintaining a release state of the exposing unit 3.

Each of the pair of bores 76 extends through the entire thickness of the base plate 70. As shown in FIGS. 12 and 13, the bores 76 allow insertion of a pair of pins 91, respectively, which are provided in the fixing means 90 of the chassis 9. Each of the pins 91 is formed with a recess 91*a* for receiving a relevant one of the claws 75. With such an arrangement, each pin 91 can selectively come into or out of engagement with the corresponding claw 75.

Referring to FIG. 12, the cover member 7 is fixed to the fixing means 90 by bringing the claws 75 of the cover member into the recesses 91*a* of the pins 91, respectively. This state is referred to as "the set state" of the cover member 7. On the other hand, referring to FIG. 13, the cover member 7 is brought into another state by bringing the claws 75 out of the respective recesses 91*a*. In this state, which is referred to as "the release state" of the cover member 7, the cover member 7 can be removed from the fixing means 90 in an N3-direction.

The operation lever 72 is arranged on an obverse side of the base plate 70 and movable between a first position (vertical position) shown in FIG. 7 and a second position (horizontal position) shown in FIG. 8. The movable plate 72*a* will pivot together with the operation lever 72. One of the claws 75 is operated by the operation lever 72 via the first link mechanism 73A, whereas the other claw 75 is operated by the operation lever 72 via the second link mechanism 73B. For operation of the claws 75, the first link mechanism 73A includes a primary link 79*c* and a secondary link 79*b*, while the second link mechanism 73B includes a primary link 79*e* and a secondary link 79*d*. With those arrangements of the first and second link mechanisms 73A–73B, the claws 75 are operated by the operation lever 72, so that the cover member 7 is selectively brought into the set state (FIGS. 7 and 12) when the operation lever 72 takes the first position and the release state (FIGS. 8 and 13) when the operation lever 72 takes the second position.

As shown in FIG. 14, the cover member 7 is provided with a cylindrical member 78*a* on the reverse side of the base plate 70. A presser member 74 having a circular cross section is slidably fitted into the cylindrical member 78*a*. The presser member 74 is formed at one end thereof with an inclined surface 74*a*. Within the cylindrical member 78*a* is also arranged a cam 78*b* provided with an inclined surface 78*c*. The presser member 74 is constantly urged downward due to a force F2 of a spring 78*d*. Thus, the presser member 74 is always held in contact with the cam 78*b*. With such an arrangement, when the cam 78*b* is rotated, the contact relationship between the two inclined surfaces 74*a*, 78*c* varies. As a result, the presser member 74 will reciprocate in an N4-direction. Specifically, when the cam 78*b* is rotated to the position shown in FIG. 14, the presser member 74 is moved upward against the force F2 of the spring 78*d* to arrive at a predetermined position. At this position, the presser member 74 comes into contact with a side surface 1*b* of the photosensitive drum 1. Here, it is assumed that the cover member 7 is attached to the fixing means 90, and that the drum 1 is located at a proper position on the shaft 2. On the other hand, when the cam 78*b* is rotated to the position shown in FIG. 15, the presser member 74 will retreat into the cylindrical member 78*a*.

The third link mechanism 73C serves to rotate the cam 78*b* in association with the operation of the operation lever 72. To this end, the third link mechanism 73C includes a primary link 79*g* and a secondary link 79*f* (see FIG. 7). The primary link 79*g* is directly connected to the movable plate 72*a*, while the secondary link 79*f* is directly connected to the cam 78*b*. With such an arrangement, when the operation lever 72 is moved to the second position (FIG. 8) for releasing the cover member 7, the cam 78*b* is rotated to the position shown in FIG. 14. On the other hand, when the operation lever 72 is moved to the first position (FIG. 7) for fixing the cover member 7, the cam 78*b* is rotated to the position shown in FIG. 15.

As shown in FIG. 7, the fourth link mechanism 73D includes a primary link 79*h* and a secondary link 79. The primary link 79*h* is directly connected to the movable plate 72*a*. The secondary link 79, associated with the primary link 79*h*, partially projects from the cover member 7. With such an arrangement, the secondary link 79 is caused to pivot vertically when the lever 72 is operated. Specifically, when the operation lever 72 is moved to the first position shown in FIG. 7, the secondary link 79 is caused to pivot downward or in an N5-direction. On the other hand, when the operation lever 72 is moved to the second position shown in FIG. 8, the secondary link 79 is caused to pivot upward or in an N6-direction. As will be described later, the fourth link mechanism 73D serves to restrict the displacement of the developing unit 4 and the sheet transferring unit 5.

As previously described, normally, the cover member 7 is attached to the fixing means 90 by the engagement of the claws 75 of the cover member 7 with the pins 91 of the fixing means 90 (see FIG. 12). In this state, the cover member 7 is kept fixed to the fixing means 90, while the first end 2*a* of the shaft 2 is properly supported for rotation via the bearing 80. Further, the side surface 1*b* of the photosensitive drum 1 is covered by the cover member 7, thereby enabling the protection of the drum 1.

For removing the drum 1 from the shaft 2, as previously described again, the user operates the operation lever 72 to bring the claws 75 out of engagement with the pins 91 (the release state of the cover member). Then, as shown in FIG. 13, the cover member 7 is detached from the fixing means 90 (see the single-dot chain lines). Thereafter, with the guide rod 89 properly connected to the shaft 2, the user can remove the drum 1 from the shaft 2, and install it (or a new drum) on the shaft 2 afterwards. In the installing operation, the user may fail to push the drum 1 sufficiently toward the second end 2*b* of the shaft 2 and may not notice it. According to the present invention, the presser member 74 can compensate for the user's improper installment. Specifically, when the cover member 7 is to be attached to the fixing means 90, the cover member is held in "the release state." In this state, as shown in FIG. 14, the presser member 74 will come into contact with the side surface 1*b* of the drum 1. Thus, when the user is attaching the cover member 7 to the fixing means 90, the presser member 74 is advantageously pushing the drum 1 toward the second end 2*b* of the shaft 2. In this way, the drum 1 is properly positioned on the shaft 2.

Referring to FIG. 15, when the operation lever 72 is operated for bringing the cover member 7 into the set state, the presser member 74 is caused to retreat into the cylindrical member 78*a* to be spaced from the side surface 1*b* of the drum 1. In this condition, the drum 1 can rotate without being interfered with by the presser member 74.

Figure 16:
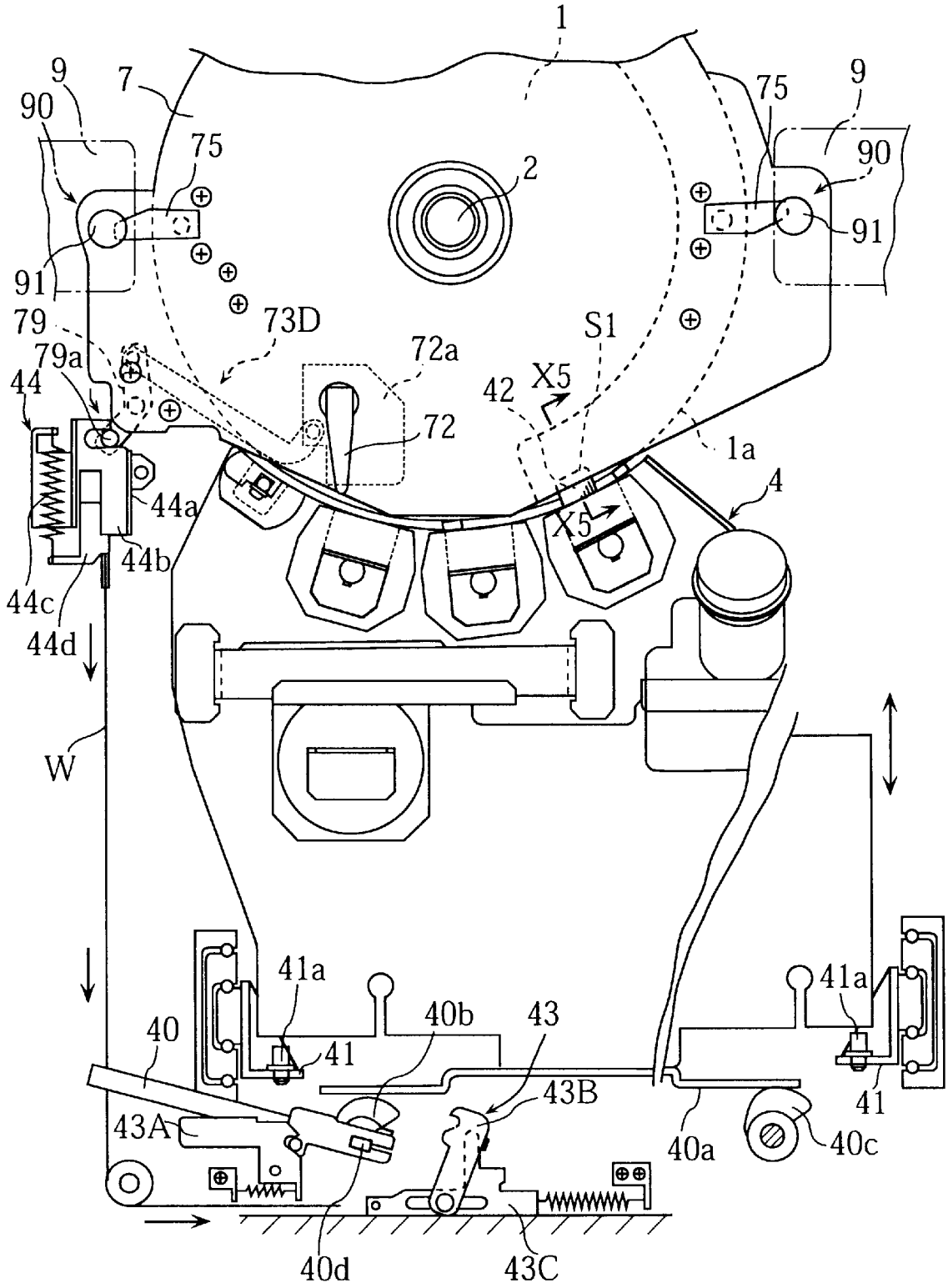
FIG. 16 is a front view showing a developing unit and relevant elements used in the electrophotographic apparatus.
Figure 17:
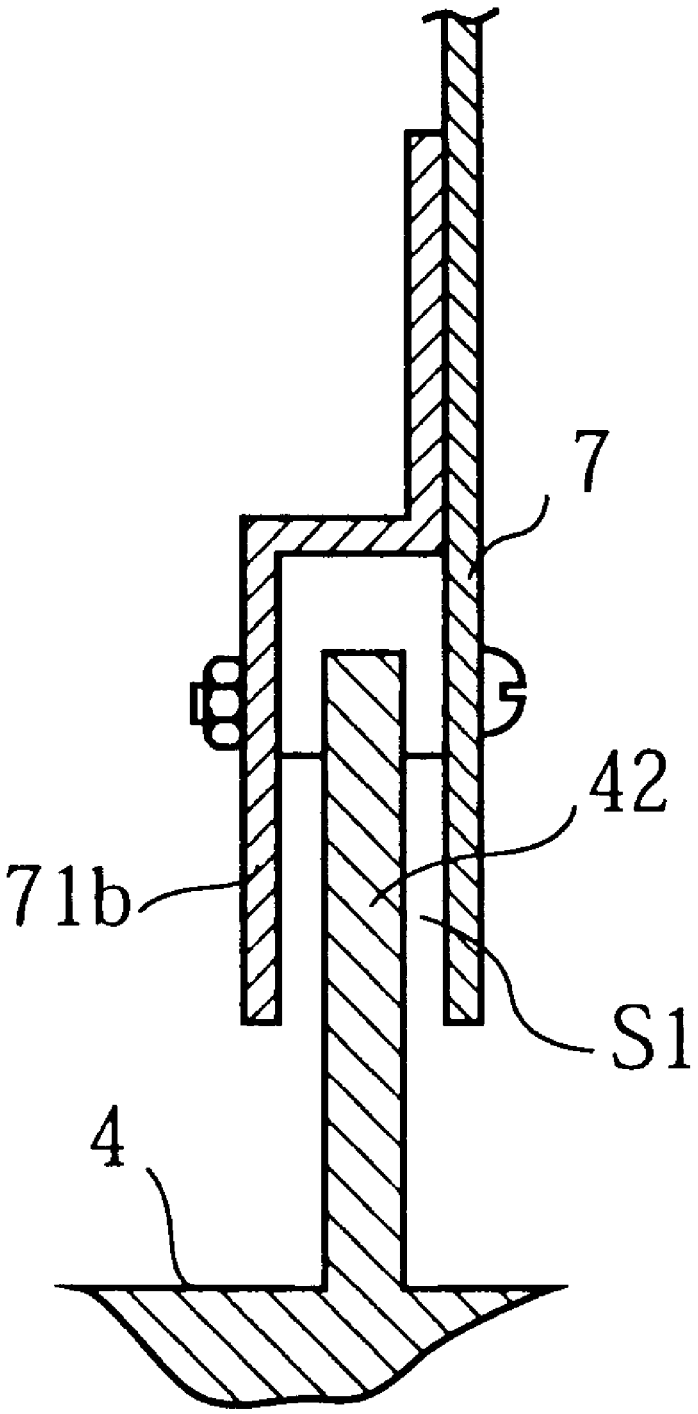
FIG. 17 is a sectional view taken along lines X5—X5 in FIG. 16.
Figure 18:
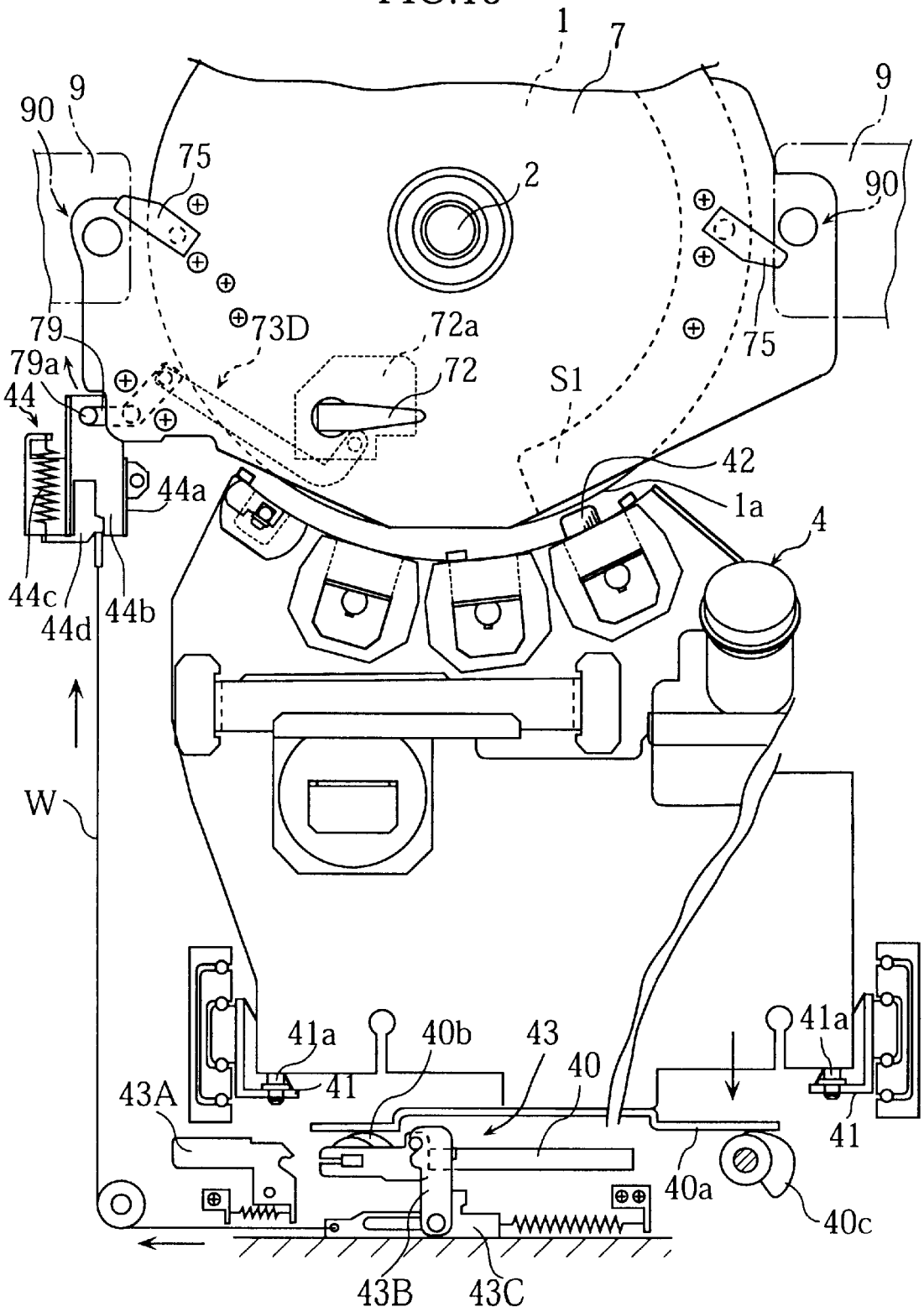
FIG. 18 is a front view showing the developing unit shifted in position.

FIG. 16 is a front view showing the developing unit 4 and relevant elements near the developing unit. FIG. 17 is a sectional view taken along lines X5—X5 in FIG. 16. FIG. 18 is a front view showing the developing unit 4 shifted downward relative to the photosensitive drum 1.

As shown in FIG. 16, the developing unit 4 is arranged below the drum 1, in facing relation to the outer surface 1*a* of the drum 1. The developing unit 4 can selectively be brought to a set state and a release state by operating a second operation lever 40. Specifically, the developing unit 4 has a bottom plate 40*a* resting on a pair of cams 40*b*, 40*c*. The second operation lever 40 is pivotable about a shaft 40*d*. Though not shown, the cam 40*c* is associated with the operation lever 40 via a suitable link mechanism. The other cam 40*b* is fixed to the shaft 40*d*. With such an arrangement, when the operation lever 40 is operated about the shaft 40*d*, the cams 40*b*, 40*c* are rotated. As a result, the developing unit 4 is displaced vertically (upward and downward) to a predetermined extent. In this way, the developing unit 4 is brought to the set state shown in FIG. 16 (in which state the developing unit 4 is adjacent to the outer surface 1*a* of the drum 1), while also brought to the release state shown in FIG. 18 (in which state the developing unit 4 is spaced away from the outer surface 1*a*). The developing unit 4 supplies toner to the outer surface 1*a* of the drum 1 when the unit 4 is held in the set state.

Below the developing unit 4 are provided a pair of sliding rails 41 positioned at a predetermined height. Each of the sliding rails 41 is horizontally movable relative to the housing of the apparatus A. With the use of the sliding rails 41, the user can conveniently pull out the developing unit 4 (together with the rails 41) from the housing of the apparatus A, while also returning the unit 4 into the housing. When the developing unit 4 is held in the set state (FIG. 16), the unit 4 does not come into contact with the sliding rails 41. On the other hand, when the developing unit 4 is held in the release state (FIG. 18), the unit 4 is supported by the sliding rails 41. In the illustrated embodiment, the sliding rails 41 are provided with upwardly projecting pins 41*a* coming into engagement with the developing unit 4. With such an arrangement, the developing unit 4 will not be unduly displaced relative to the rails 41 even when the unit 4 is taken out of or brought back into the housing of the apparatus A.

The illustrated apparatus A includes an engaging portion 42 arranged at a head portion of the developing unit 4. Further, the apparatus A includes a mechanism 43 for restricting the positional change of the developing unit 4, and an auxiliary mechanism 44.

The engaging portion 42 is a flat plate projecting upward from the developing unit 4, as best shown in FIG. 17. The engaging portion 42 is received in the space S1 (described with reference to FIG. 10) for engagement with the cover member 7, when the cover member 7 is attached to the fixing means 90 and the developing unit 4 is raised into the set state. However, when the developing unit 4 is lowered into the release state as shown in FIG. 18, the engaging portion 42 is freed from engagement with the cover member 7, coming out of the space S1.

The auxiliary mechanism 44 is provided for supplementing the operation of the restricting mechanism 43. In addition, as will be described later, the auxiliary mechanism 44 is also used for restricting the positional change of the sheet transferring unit 5. The auxiliary mechanism 44 includes a stationary holder 44*a* fixed relative to the housing of the apparatus A, a movable carrier 44*b* supported by the holder 44*a* for vertical movement, and a spring 44*c* constantly providing an upward urging force with the carrier 44*b*. An end of a wire W is connected to the carrier 44*b* via an attachment 44*d*. As illustrated, the attachment 44*d* is fixed to a lower portion of the carrier 44*b*. An upper portion of the carrier 44*b* is engaged with a pin 79*a* projecting from the secondary link 79 of the fourth link mechanism 73D. With such an arrangement, the carrier 44*b* is moved upward or downward as the link 79 is caused to pivot. Accordingly, the wire W connected to the carrier 44*b* is pulled vertically (upward and downward). Specifically, when the cover member 7 is held in the set state as shown in FIG. 16, the link 79 and the carrier 44*b* are lowered, thereby rendering the wire W pulled downward. On the other hand, when the cover member 7 is held in the release state as shown in FIG. 18, the link 79 and the carrier 44*b* are raised in position, thereby rendering the wire W pulled upward.

Figure 19:
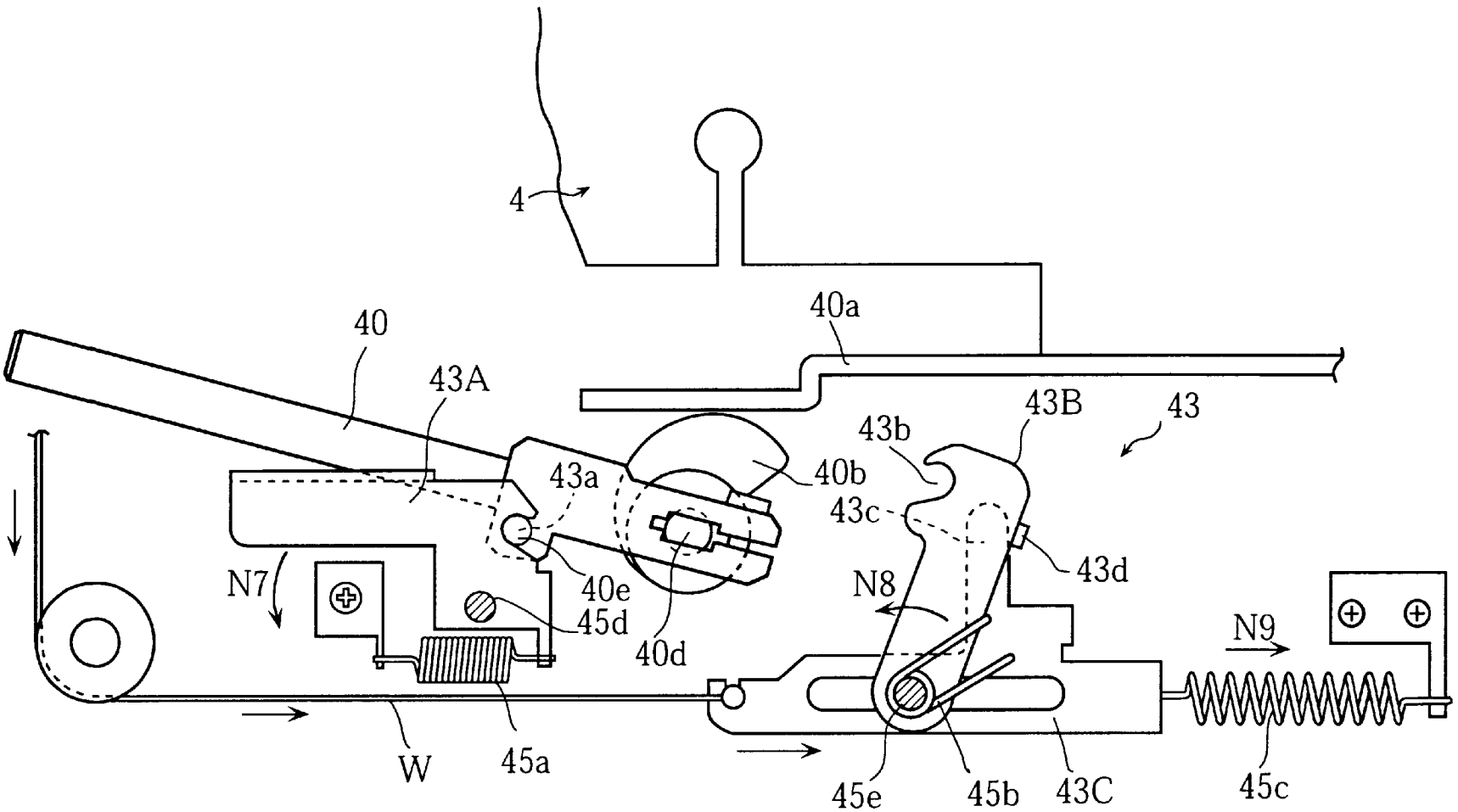
FIG. 19 is a front view showing a restricting mechanism for positional change.
Figure 20:
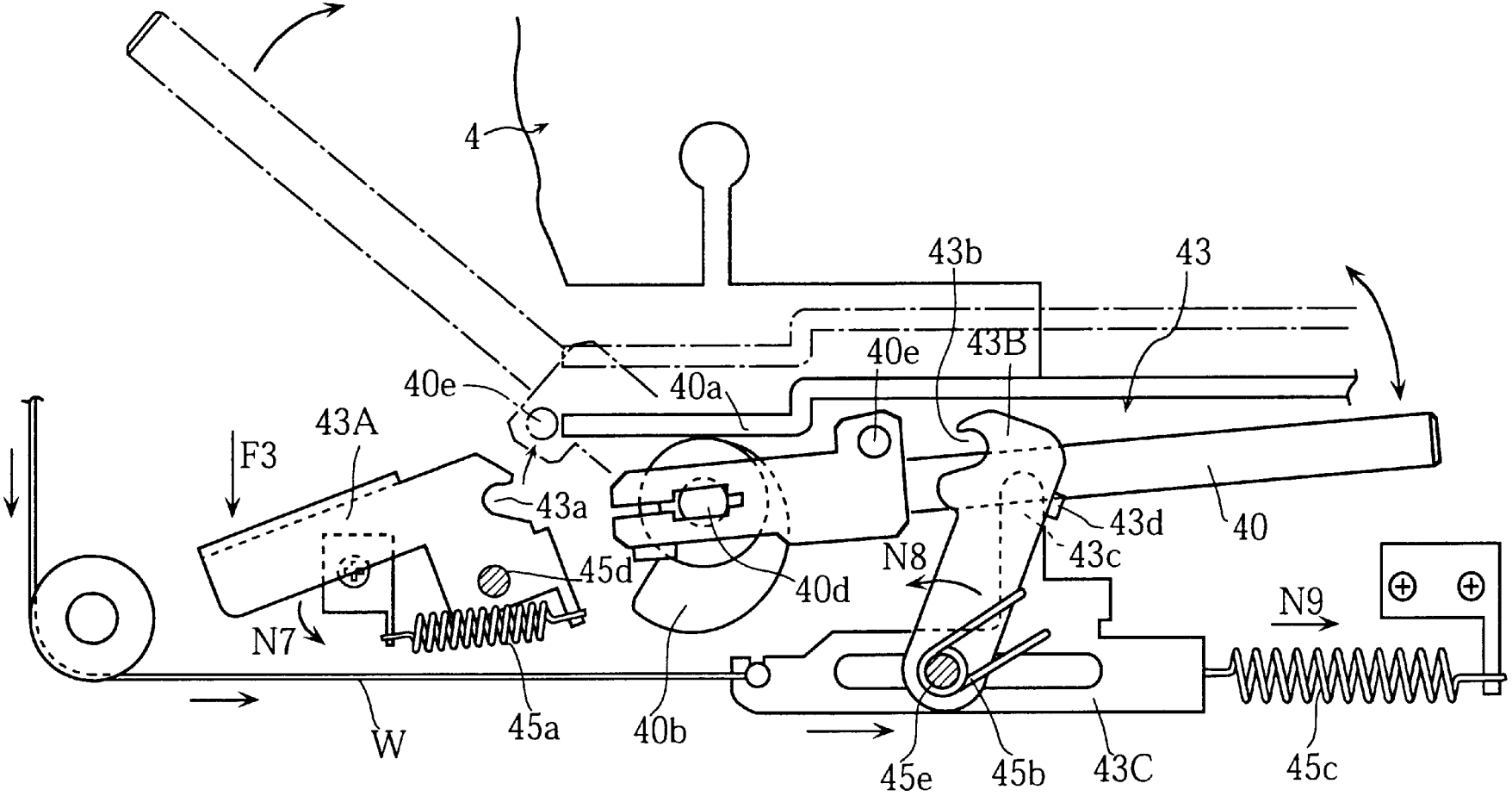
FIG. 20 is a front view illustrating how the restricting mechanism of FIG. 19 works.
Figure 21:
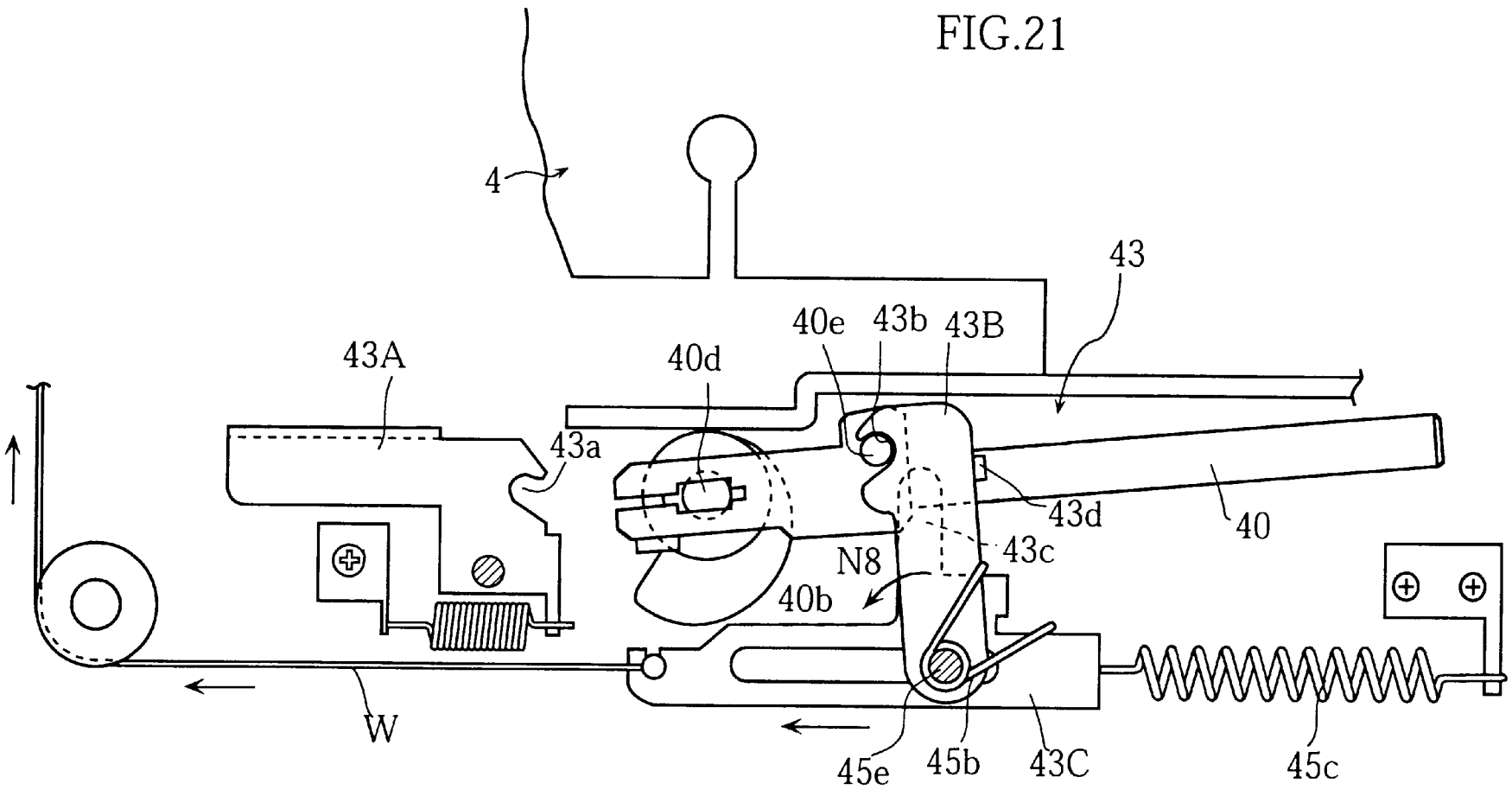
FIG. 21 is a front view showing the restricting mechanism in operation.

FIG. 19 is a front view showing principal parts of the restricting mechanism 43. FIGS. 20 and 21 illustrate how the restricting mechanism 43 is operated.

Referring to FIG. 19, the restricting mechanism 43, which is provided for locking the operation lever 40, includes a first latch member 43A, a second latch member 43B, a slider 43C and three springs 45*a*–45*c*.

The first latch member 43A is supported by a stationary shaft 45*d* for rotational movement. The latch member 43A is formed with a recess 43*a* for receiving a horizontally projecting pin 40*e* of the operation lever 40. When the latch member 43A is rotated counterclockwise or in an N7-direction, the latch member 43A will receive a restoring force from the spring 45*a* which urges the latch member back to the initial position. The spring 45*a* also serves to prevent the latch member 43A from unduly rotating beyond a predetermined extent clockwise or in the direction opposite to the N7-direction. According to the illustrated embodiment, the user needs to operate the operation lever 40 to the left (or counterclockwise) in FIG. 19 for bringing the developing unit 4 into the set state. At this time, the first latch member 43A is pushed down from above by the operation lever 40, pivoting slightly in the N7-direction. As a result, the pin 40*e* comes into engagement with the recess 43*a*, whereby the operation lever 40 is positionally fixed by the first latch member 43A. For releasing the latched operation lever 40, the first latch member 43A is additionally rotated in the N7-direction with a suitable force F3, as shown in FIG. 20. In this way, the pin 40*e* is released from the engagement with the recess 43*a*, and the operation lever 40 becomes freely movable.

Likewise, the second latch member 43B is supported by a stationary shaft 45*e* for rotational movement. The second latch member 43B is formed with a recess 43*b* for receiving the pin 40*e* of the operation lever 40. The spring 45*b* constantly applies an urging force to the second latch member 43B in an N8-direction (see FIG. 19 for example).

The slider 43C, which is horizontally movable, has a first end connected to the wire W and a second end connected to the spring 45*c*. The spring 45*c* constantly applies to an urging force to the slider 43C in an N9-direction. With such an arrangement, the slider 43C is displaced to the left or to the right, depending on the strengths of the wire's pulling force and the spring 45*c*.

The slider 43C is provided with a restricting portion 43*c* for restricting the pivotal movement of the second latch member 43B in the N8-direction. To this end, the restricting portion 43*c* is formed as an upright projection, while the second latch member 43B is provided with a stopper 43*d* at a suitable position as shown in FIG. 19. With such an arrangement, the stopper 43*d* of the second latch member 43B can come into engagement with the restricting portion 43*c* of the slider 43C. Thus, though the second latch member 43B is constantly urged in the N8-direction by the spring 45*b,* the pivoting of the second latch member 43B can be checked by the stopper 43*d* coming into engagement with the restricting portion 43*c*.

More specifically, as shown in FIGS. 19 and 20, when the slider 43C (and the restricting portion 43*c*) is displaced in the right direction, the second latch member 43B takes positions in which the latch member 43B does not come into engagement with the pin 40*e* of the operation lever 40. Thus, in these positions, the operation lever 40 cannot be latched by the second latch member 43B. On the other hand, as shown in FIG. 21, when the slider 43C is displaced to the left, the second latch member 43B is allowed to pivot further in the N8-direction. When the second latch member 43B is thus moved, the pin 40*e* of the operation lever 40 can come into engagement with the recess 43*b,* rendering the operation lever 40 latched by the second latch member 43B.

In the electrophotographic apparatus A, as shown in FIG. 16, the engaging portion 42 of the developing unit 4 is held in engagement with the cover member 7 when the cover member 7 and the developing unit 4 are in their set states. At this stage, since the lateral movement of the cover member 7 is restricted by the engaging portion 42, the user cannot detach the cover member 7 from the fixing means 90 even if he brings the cover member 7 into the release state. When the cover member 7 is not detached from the fixing means 90, the photosensitive drum 1 cannot be removed from the shaft 2. With such an arrangement, according to the present invention, it is possible to prevent the drum 1 from being unduly removed from the shaft 2 when the developing unit 4 is held in the set state.

When the cover member 7 is held in the set state, the wire W is displaced in the direction going from the auxiliary mechanism 44 to the restricting mechanism 43. In this instance, as previously described, the second latch 43B cannot latch the operation lever 72. Thus, as shown in FIG. 20, the operation lever 40 can be freely operated about the shaft 40*d* once the operation lever 40 is freed from the first latch member 43A by applying a pressing force F3 to the first latch member. This means that the developing unit 4 can be moved upward and downward by the user even when the cover member 7 is held in the set state.

Removal of the photosensitive drum 1 is performed as follows. Referring to FIG. 18, after the developing unit 4 is brought into the release state, the cover member 7 is also brought into the release state, thereby enabling the user to detach the cover member from the fixing means 90. When the developing unit 4 is lowered into the release state, the engaging portion 42 comes out of engagement with the cover member 7. At this stage, the cover member 7 can be properly detached. When the cover member 7 is held in the release state, the wire W is pulled by the auxiliary mechanism 44, thereby enabling the operation lever 40 to be latched by the second latch member 43B. Thus, the developing unit 4 is held in the release state. In this instance, the photosensitive drum 1 can be removed from the shaft 2, with the developing unit 4 held in the release state. As a result, it is possible to more effectively prevent the photosensitive drum 1 from unduly coming into contact with the developing unit 4.

In the electrophotographic apparatus A, not only the photosensitive drum 1 but the developing unit 4 may have to be taken out of the housing of the apparatus A for performing replacement or maintenance for example. According to the illustrated embodiment, it is arranged that the developing unit 4 cannot be taken out unless the unit 4 is lowered into the release state. With such an arrangement, the outer surface 1*a* of the drum 1 will not be damaged by the developing unit 4 being taken out of the housing of the apparatus A.

Figure 22:
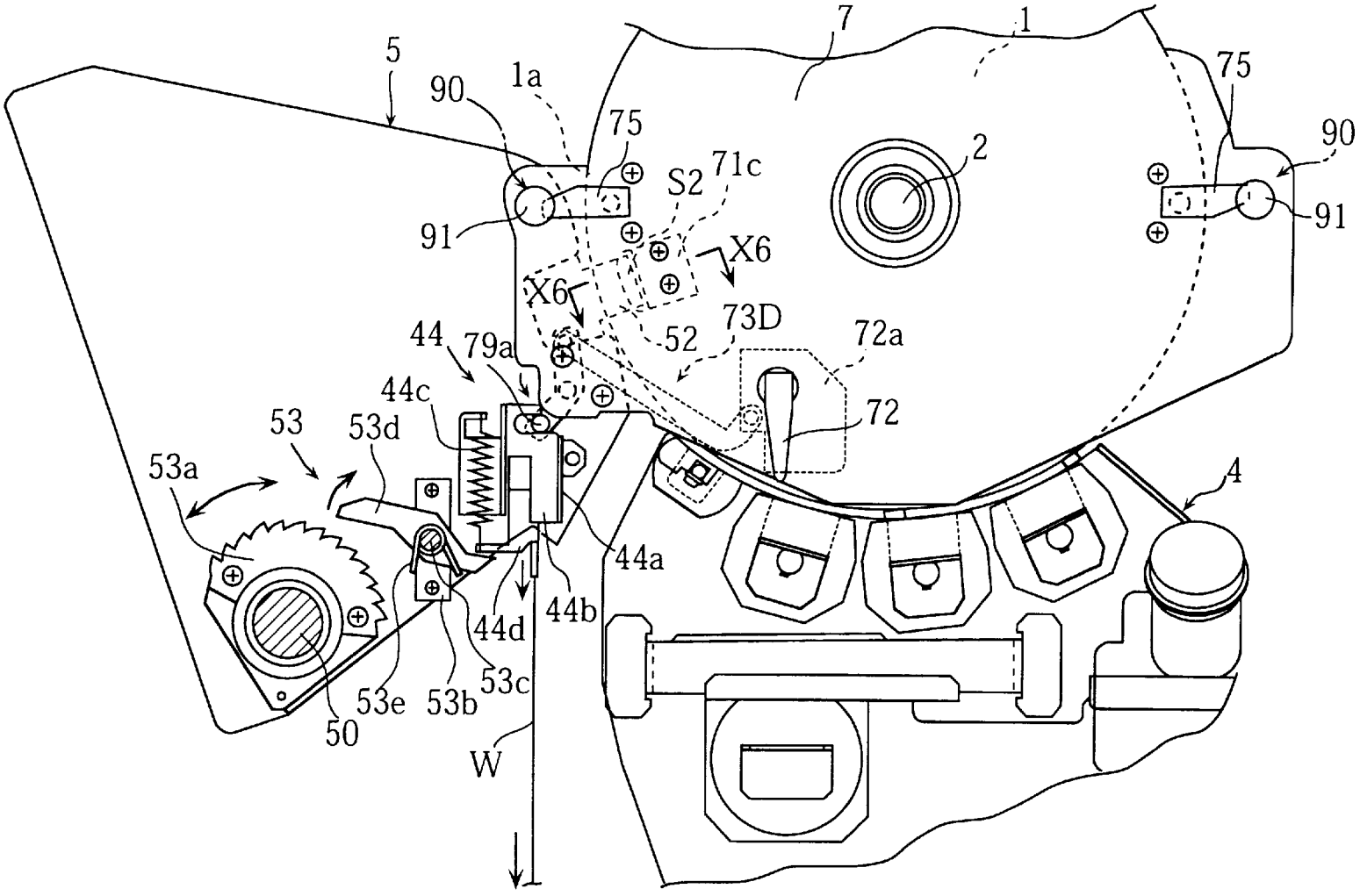
FIG. 22 is a front view showing a sheet transferring unit and relevant elements used in the electrophotographic apparatus.
Figure 23:
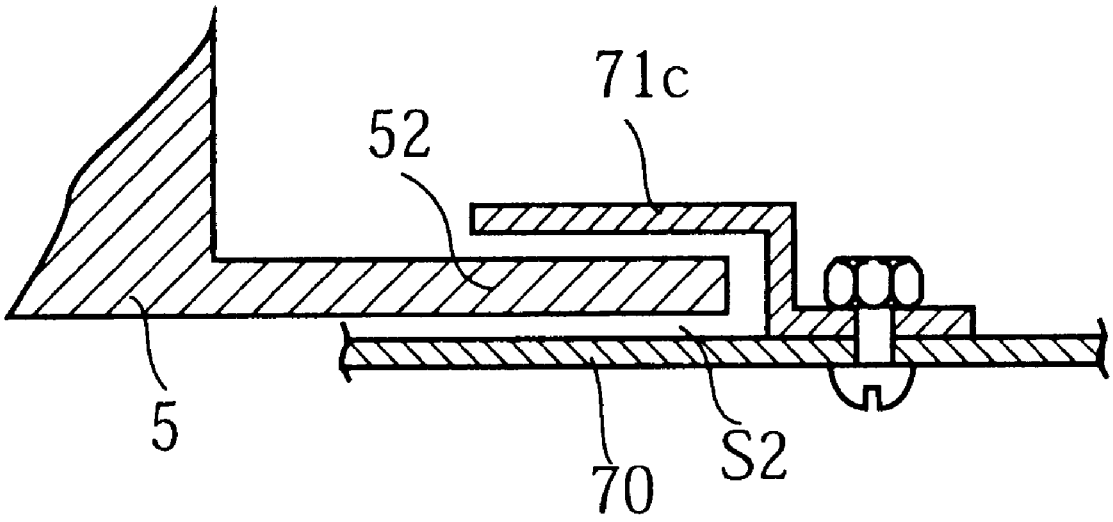
FIG. 23 is a sectional view taken along lines X6—X6 in FIG. 22.
Figure 24:
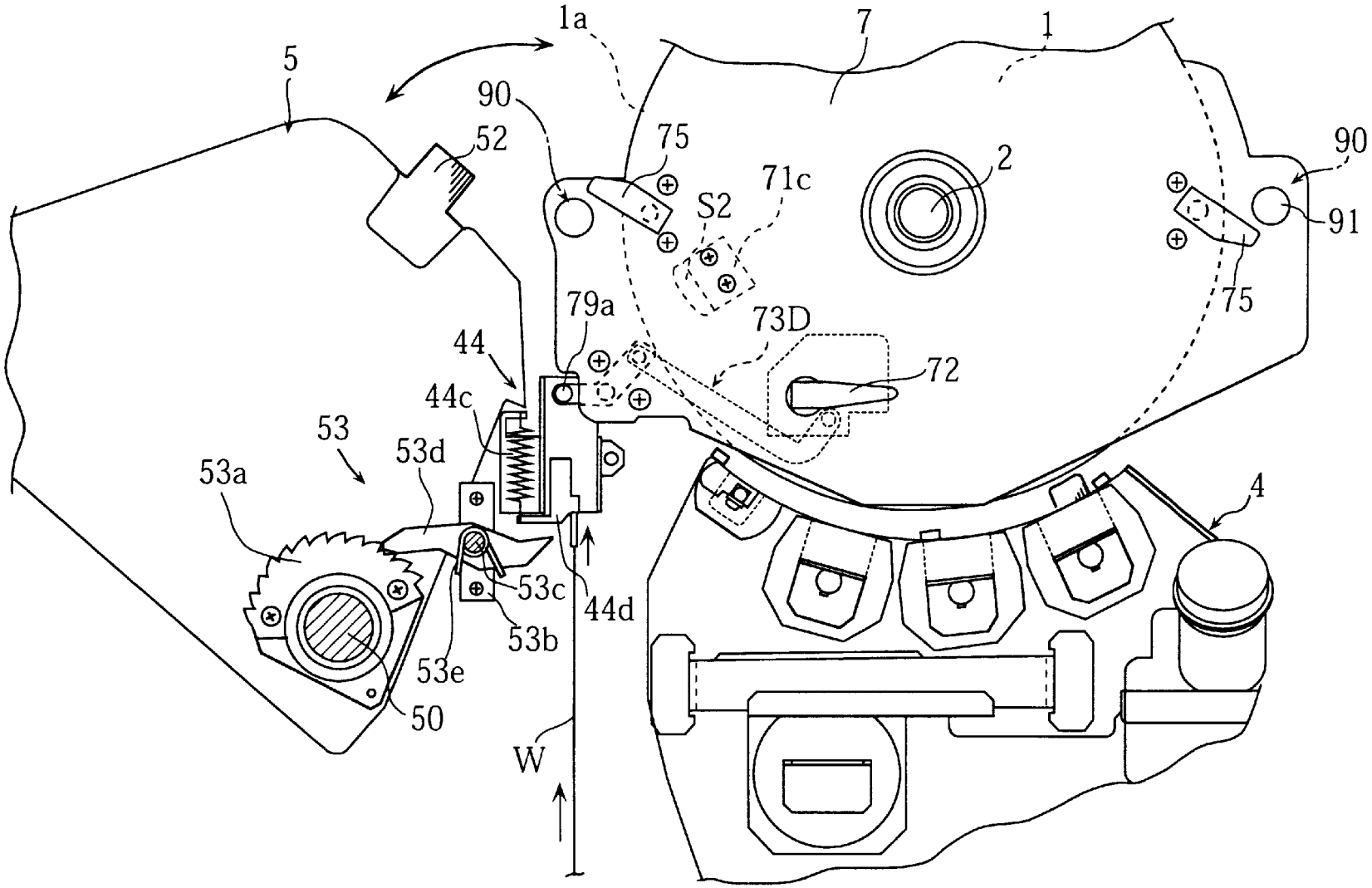
FIG. 24 is a front view showing the sheet transferring unit shifted in position.

FIG. 22 is a front view illustrating the sheet transferring unit 5 and relevant elements. FIG. 23 is a sectional view taken along lines X6—X6 in FIG. 22. FIG. 24 is a front view showing the sheet transferring unit 5 brought to a different position.

As shown in FIG. 22, the sheet transferring unit 5 is arranged on a side of the photosensitive drum 1 in facing relation to the outer surface 1*a* of the drum 1. The sheet transferring unit 5 is rotatably supported by a stationary shaft 50 extending in parallel to the shaft 2. With such an arrangement, the sheet transferring unit 5 is selectively brought into two states, i.e., a set state where the unit 5 is close to the outer surface 1*a* of the drum 1 as shown in FIG. 22, and a release state where the unit 5 is more spaced from the outer surface 1*a* as shown in FIG. 24. The sheet transferring unit 5, when held in the set state, serves to bring a recording paper sheet (not shown) into engagement with the outer surface 1*a* of the drum 1.

As best shown in FIG. 24, the electrophotographic apparatus A includes an engaging portion 52 arranged at a side surface of the sheet transferring unit 5. Further, the apparatus A includes a mechanism 53 for restricting freedom of positional change of the sheet transferring unit 5.

The engaging portion 52 is a flat projection protruding from the side surface of the sheet transferring unit 5. As can be seen from FIGS. 22 and 23, the engaging portion 52 is received in the space S2 (previously described with reference to FIG. 11) when the sheet transferring unit 5 is held in the set state and the cover member 7 is attached to the fixing means 90. On the other hand, the engaging portion 52 comes out of the space S2 when the sheet transferring unit 5 is brought into the release state, as shown in FIG. 24.

The restricting mechanism 53 includes ratchet gear 53*a* fixed to the shaft 50, and a pawl 53*d* supported by a shaft 53*c* for rotational movement. The shaft 53*c* extends from a holder 53*b* which is arranged stationary relative to the housing of the apparatus A. The pawl 53*d* is held in contact with the ratchet gear 53*a* under an urging force of a spring 53*e*. The pivotal movement of the pawl 53*d* is controlled by the attachment 44*d* of the auxiliary mechanism 44. Specifically, the pawl 53*d,* which has a rather elongated configuration, has an end arranged in facing relation to the attachment 44*d,* as shown in FIG. 22. Thus, when the attachment 44*d* is lowered, the above-mentioned end of the pawl 53*d* is pushed downward. At this time, the other end of the pawl 53*d* comes out of engagement with the ratchet gear 53*a*. On the other hand, when the attachment is raised, as shown in FIG. 24, the pawl 53*d* is rotated counterclockwise due to the urging force of the spring 53*e* and brought into engagement with the ratchet gear 53*a*. In this instance, the sheet transferring unit 5 cannot pivot counterclockwise about the shaft 50.

In the illustrated apparatus A, as shown in FIG. 22, the engaging portion 52 of the sheet transferring unit 5 is held in engagement with the cover member 7, when the cover member 7 is attached to the fixing means 90 and the sheet transferring unit 5 is held in the set state. In this manner, the engaging portion 52 serves to restrict the lateral movement of the cover member 7. With such an arrangement, the cover member 7 cannot be detached from the fixing means 90 even when the user brings the cover member 7 into the release state. Therefore, it is possible to prevent the photosensitive drum 1 from being unduly removed while the sheet transfer unit 5 is being held in the set state. As a result, the outer surface 1*a* of the drum 1 will not be damaged through otherwise possible engagement with the sheet transferring unit 5.

Further, when the cover member 7 is held in the set state, the attachment 44*d* of the auxiliary mechanism 44 is lowered, bringing the pawl 53*d* out of engagement with the ratchet gear 53*a*. At this stage, the sheet transferring unit 5 is pivotable about the stationary shaft 50. Thus, the sheet transferring unit 5 can be selectively brought into either one of the set and release states.

Removal of the photosensitive drum 1 is performed as follows. The cover member 7 is brought into the release state after the sheet transferring unit 5 is brought into the release state, as shown in FIG. 24. At this stage, the cover member 7 is detached from the fixing means 90. When the sheet transferring unit 5 is held in the release state, the engaging portion 52 comes out of engagement with the cover member 7, thereby enabling the user to properly detach the cover member 7. Further, when the cover member 7 is held in the release state, the attachment 44 of the auxiliary mechanism 44 is raised, causing the pawl 53*d* to come into engagement with the ratchet gear 53*a*. In this instance, the sheet transferring unit 5 cannot be brought into the set state. Thus, the user can remove the photosensitive drum 1 while the sheet transferring unit 5 is being held in the release state. In this manner, it is possible to prevent the drum 1 from being unduly damaged by the sheet transferring unit 5. At a later time, when the drum 1 is installed on the shaft 2 again and the cover member 7 is brought back into the set state, the pawl 53*d* comes out of engagement with the ratchet gear 53*a*. At this stage, the sheet transferring unit 5 can be brought back into the set state.

Figure 25:
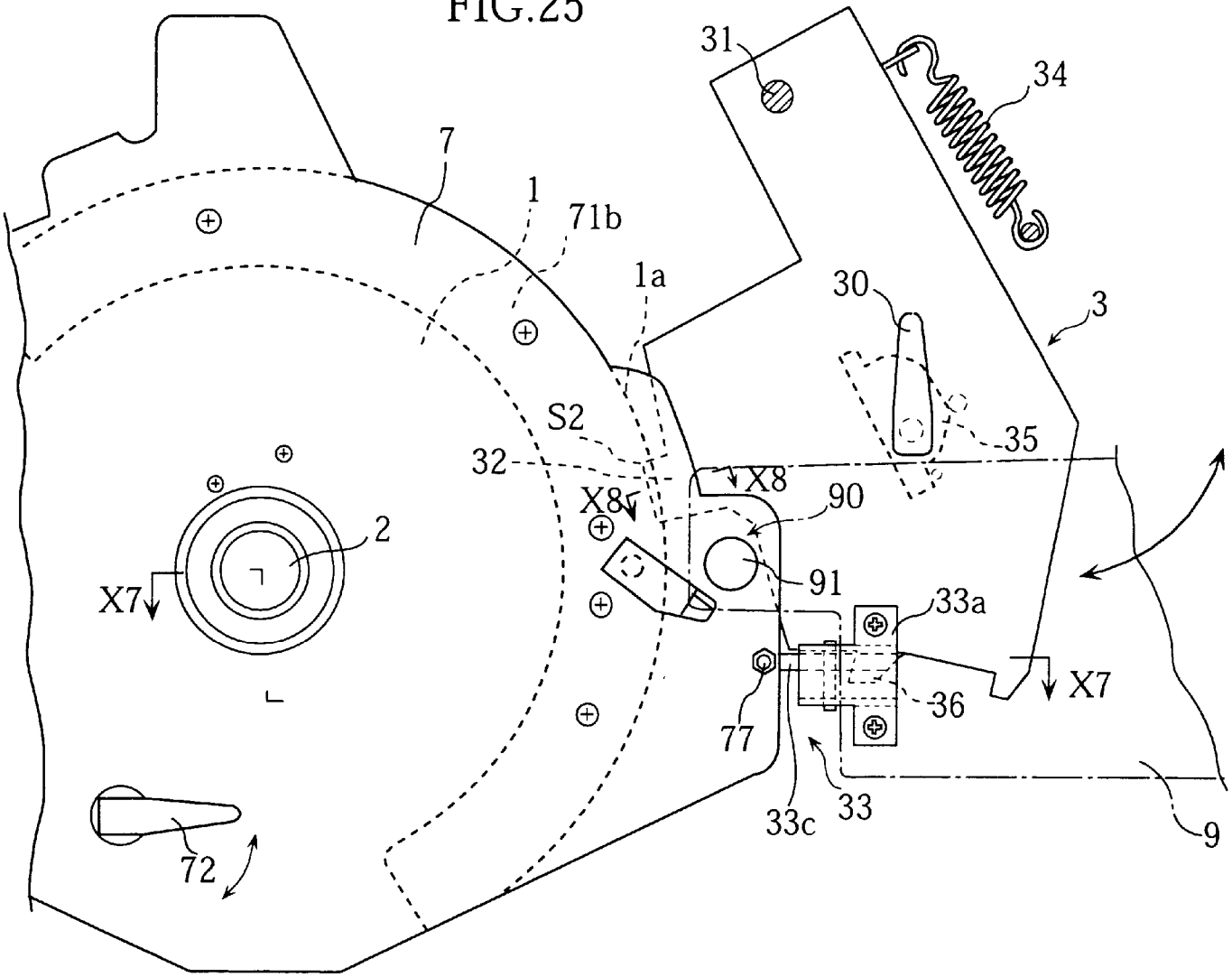
FIG. 25 is a front view showing an exposing unit and relevant elements used in the electrophotographic apparatus.
Figure 26:
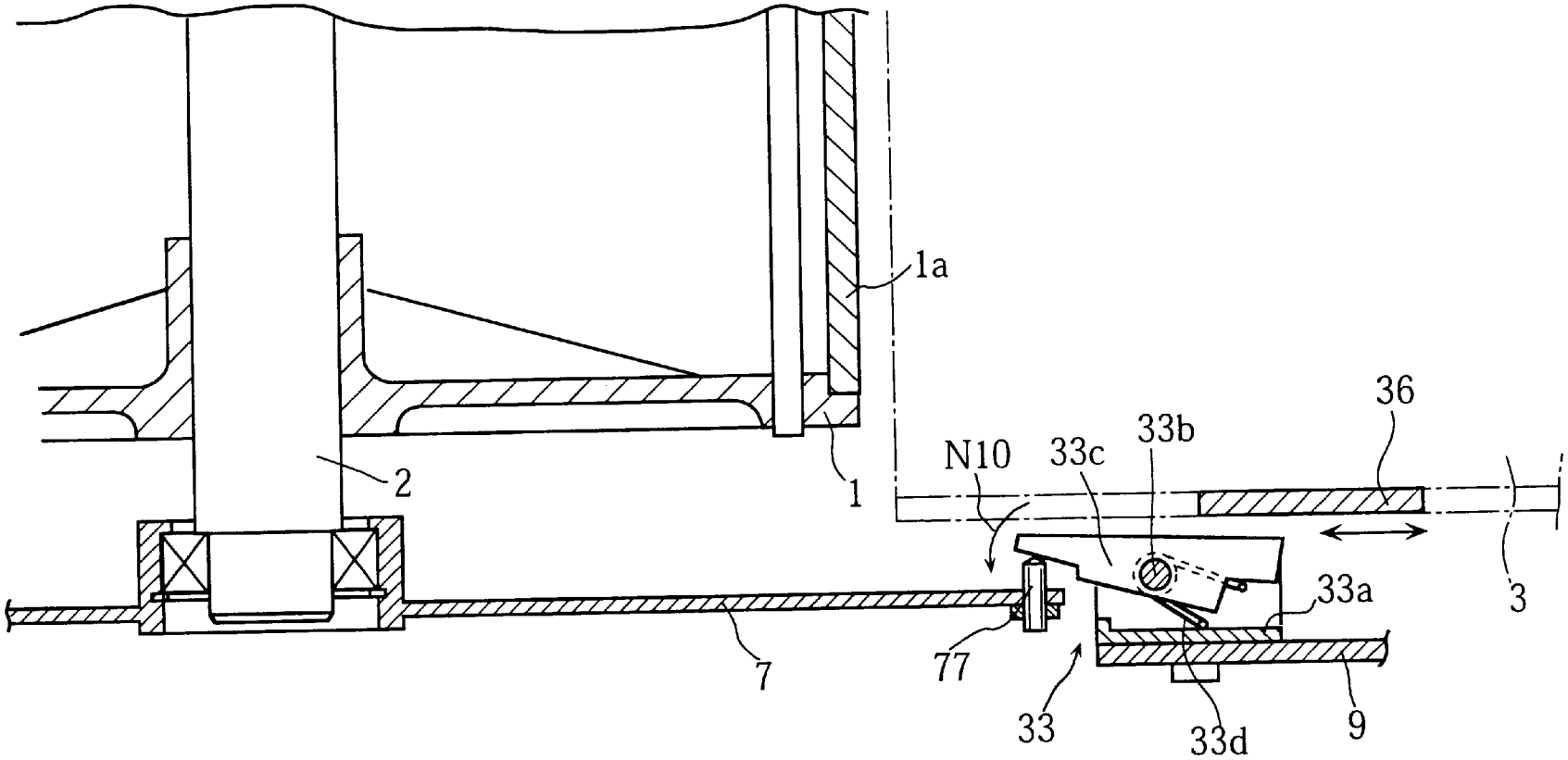
FIG. 26 is a sectional view taken along lines X7—X7 in FIG. 25.
Figure 27:
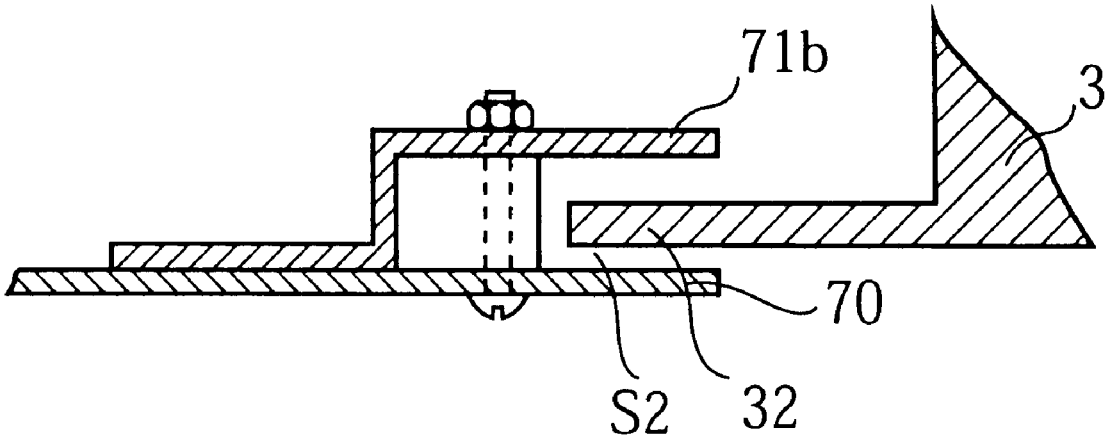
FIG. 27 is a sectional view taken along lines X8—X8 in FIG. 25.
Figure 28:
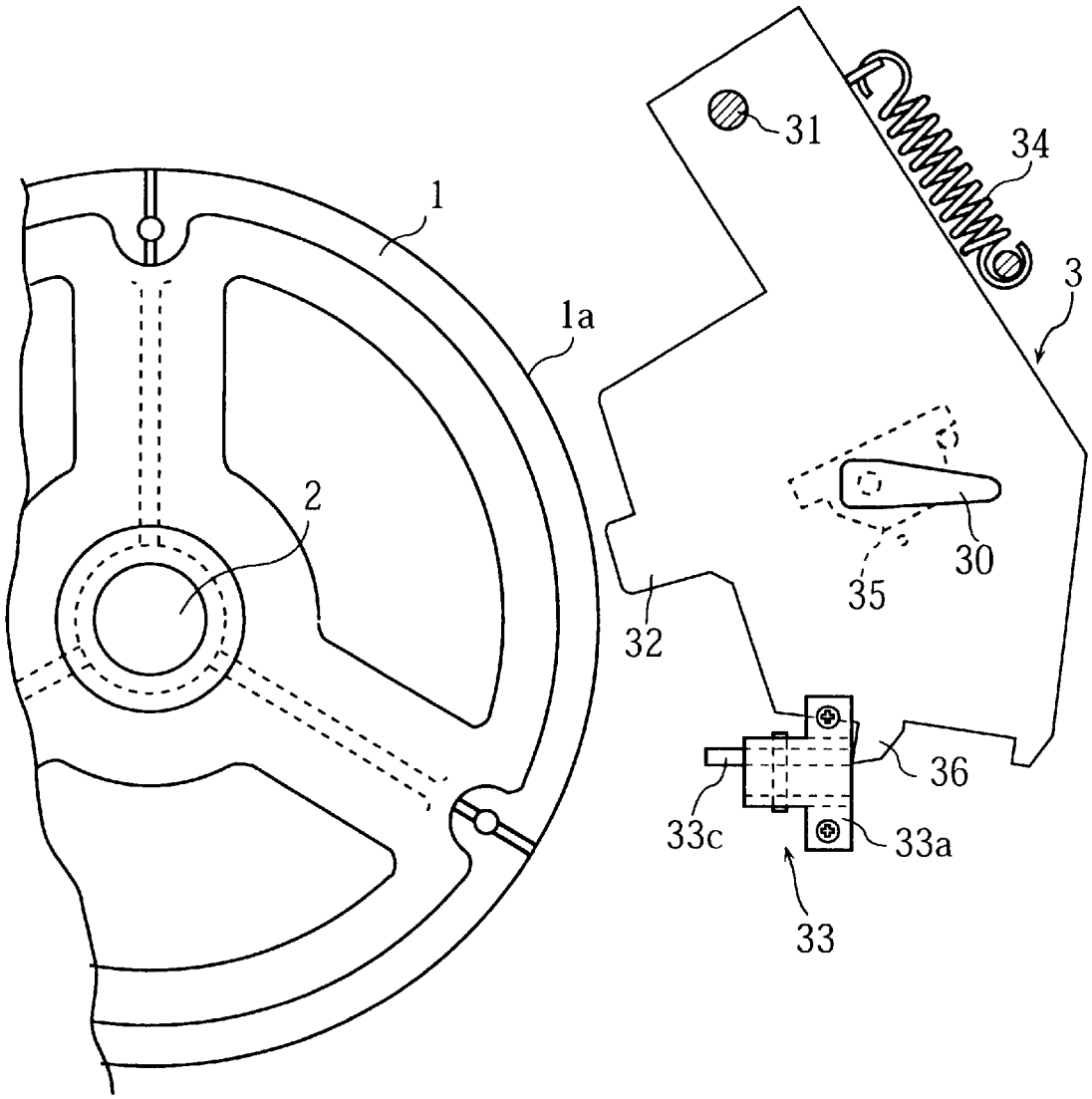
FIG. 28 is a front view showing the exposing unit shifted in position.
Figure 29:
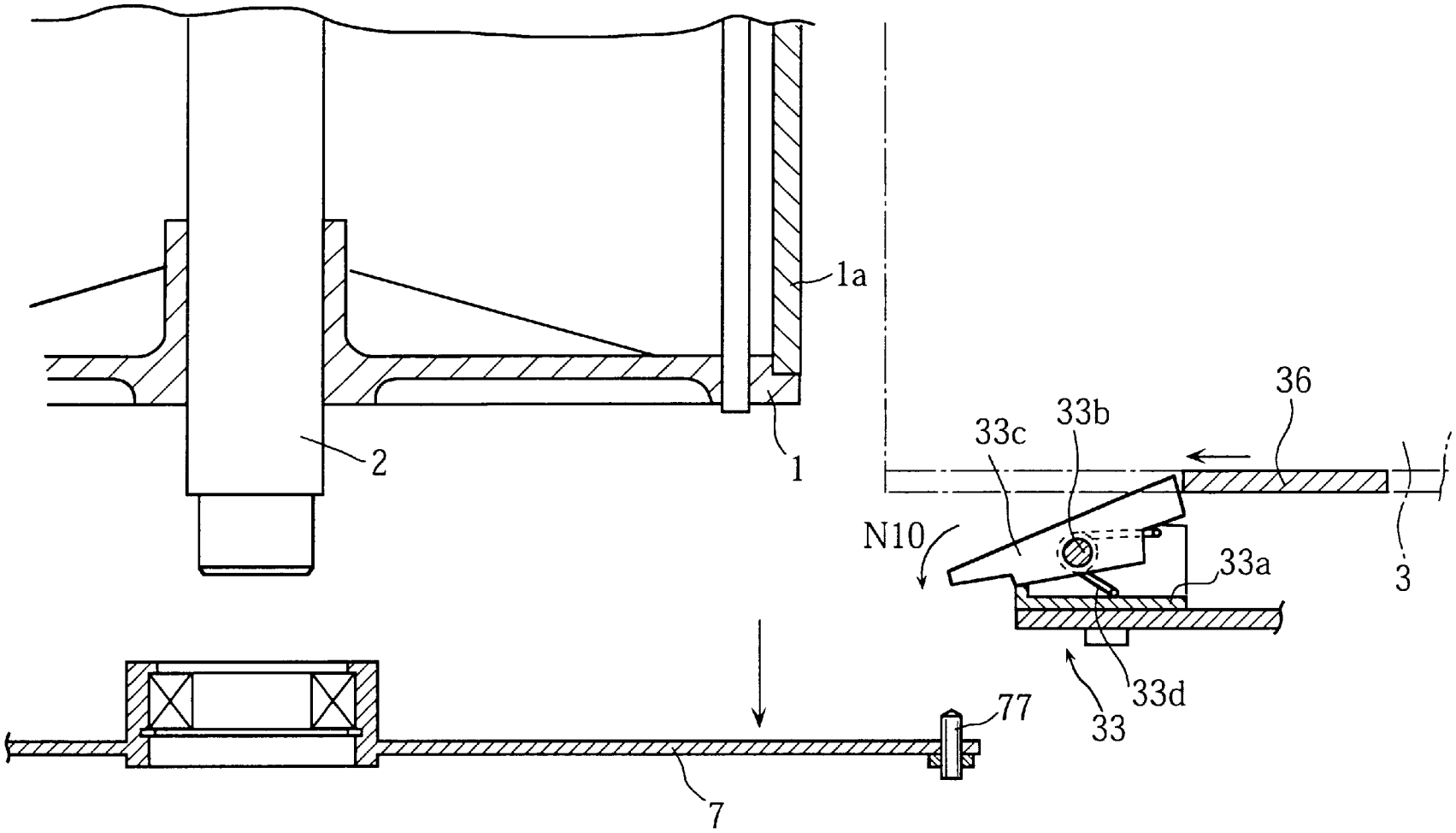
FIG. 29 is a sectional plan view showing the unit and elements of FIG. 28.

FIG. 25 is a front view showing the exposing unit 3 and relevant elements near the exposing unit. FIG. 26 is a sectional view taken along lines X7—X7 in FIG. 25. FIG. 27 is a sectional view taken along lines X8—X8 in FIG. 25. FIG. 28 is a front view showing the exposing unit 3 at a different position. FIG. 29 is a sectional view showing principal parts of the components shown in FIG. 28.

As shown in FIG. 25, the exposing unit 3 is arranged on the other side of the drum 1 (opposite to the sheet transferring unit 5 across the drum 1) in facing relation to the outer surface 1*a* of the drum 1. The exposing unit 3 is pivotable about a stationary shaft 31. The user can selectively bring the exposing unit 3 into two states by operating an operation lever 30 arranged in facing relation to a side surface of the exposing unit 3. The two states are a set state where the exposing unit 3 is close to the outer surface 1*a* of the drum 1, and a release state where the exposing unit 3 is spaced away from the outer surface 1*a* of the drum 1. The exposing unit 3 is connected to a spring 34 for urging the unit 3 to be closer to the outer surface 1*a* of the drum 1. Further, the exposing unit 3 is provided with a cam 35 for stabilizing the posture of the exposing unit 3. The exposing unit 3 irradiates the outer surface 1*a* with light when the exposing unit 3 is held in the set state.

The illustrated apparatus A includes an engaging portion 32 arranged at a side surface of the exposing unit 3, and a mechanism 33 for restricting the movement of the exposing unit 3.

As can be seen from FIG. 27, the engaging portion 32 is a flat projection extending from the exposing unit 3. The engaging portion 32 is received in the space S2 (see also FIG. 10), when the cover member 7 is attached to the fixing means 90 and the exposing unit 3 is held in the set state. On the other hand, when the exposing unit 3 is held in the release state shown in FIG. 28, the engaging portion 32 comes out of the space S2, in other words, out of engagement with the cover member 7.

As best shown in FIG. 26, the restricting mechanism 33 includes a stopper 33*c* supported by a stationary shaft 33*b* for rotational movement. The shaft 33*b* extends from a holder 33*a* fixed to the chassis 9. The restricting mechanism 33 also includes a spring 33*d* serving to constantly urge the stopper 33*c* in an N10-direction. The stopper 33*c* comes into contact with a pin 77 of the cover member 7 when the cover member is attached to the fixing means 90. At this stage, the stopper 33*c* does not engage with a projection 36 of the exposing unit 3 (see also FIG. 25). Thus, the exposing unit 3 can be rotated about the shaft 32 without being interfered with by the stopper 33*c*. On the other hand, as shown in FIG. 29, when the stopper 33*c* is not held in contact with the pin 77, the stopper is rotated in the N10-direction due to the urging force of the spring 33*d*. In this instance, the stopper 33*c* comes into engagement with the projection 36 of the exposing unit 3, as illustrated. In this manner, the exposing unit 3 is prevented from coming improperly close to the outer surface 1*a* of the drum 1.

In the illustrated apparatus A, when the exposing unit 3 is in the set state, the engaging portion 32 of the exposing unit 3 comes into engagement with the cover member 7. Thus, even when the user brings the cover member 7 into the release state, he cannot remove the cover member from the shaft 2, much less the drum 1. In this way, it is possible to prevent the outer surface 1*a* of the drum 1 from being unduly damaged by the exposing unit 3.

Removal of the drum 1 is performed as follows. The cover member 7 is detached from the fixing means 90 after the exposing unit 3 is brought into the release state, as shown in FIG. 28. When the exposing unit 3 is in the release state, the engaging portion 32 is freed from engagement with the cover member 7, whereby the user can properly remove the cover member 7. When the cover member 7 is removed, the stopper 33*c* comes into contact with the projection 36 of the exposing unit 3, as shown in FIG. 29. Therefore, even when the exposing unit 3 is rotated toward the drum 1, such movement can be checked by the stopper 33*c* coming into engagement with the projection 36. Thus, it is possible to prevent the drum 1 from being unduly damaged by the exposing unit 3. At a later time, when the cover member 7 is attached to the fixing means 90 again, the projection 36 is released from the engagement with the stopper 33*c* (FIG. 26). At this stage, the user can bring the exposing unit 3 back into the set state.

Figure 30:
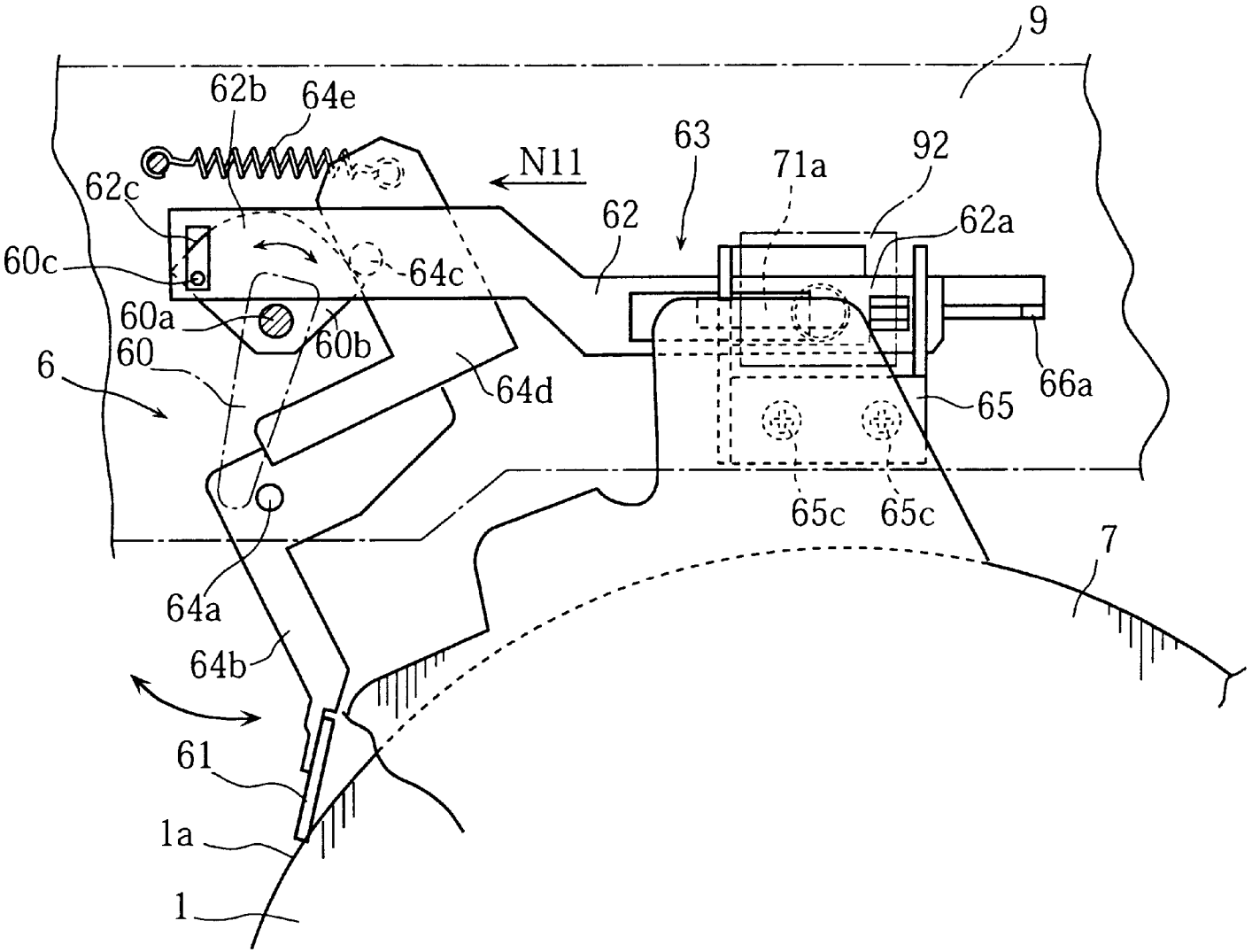
FIG. 30 is a front view showing a cleaning unit and relevant elements used in the electrophotographic apparatus.
Figure 31:
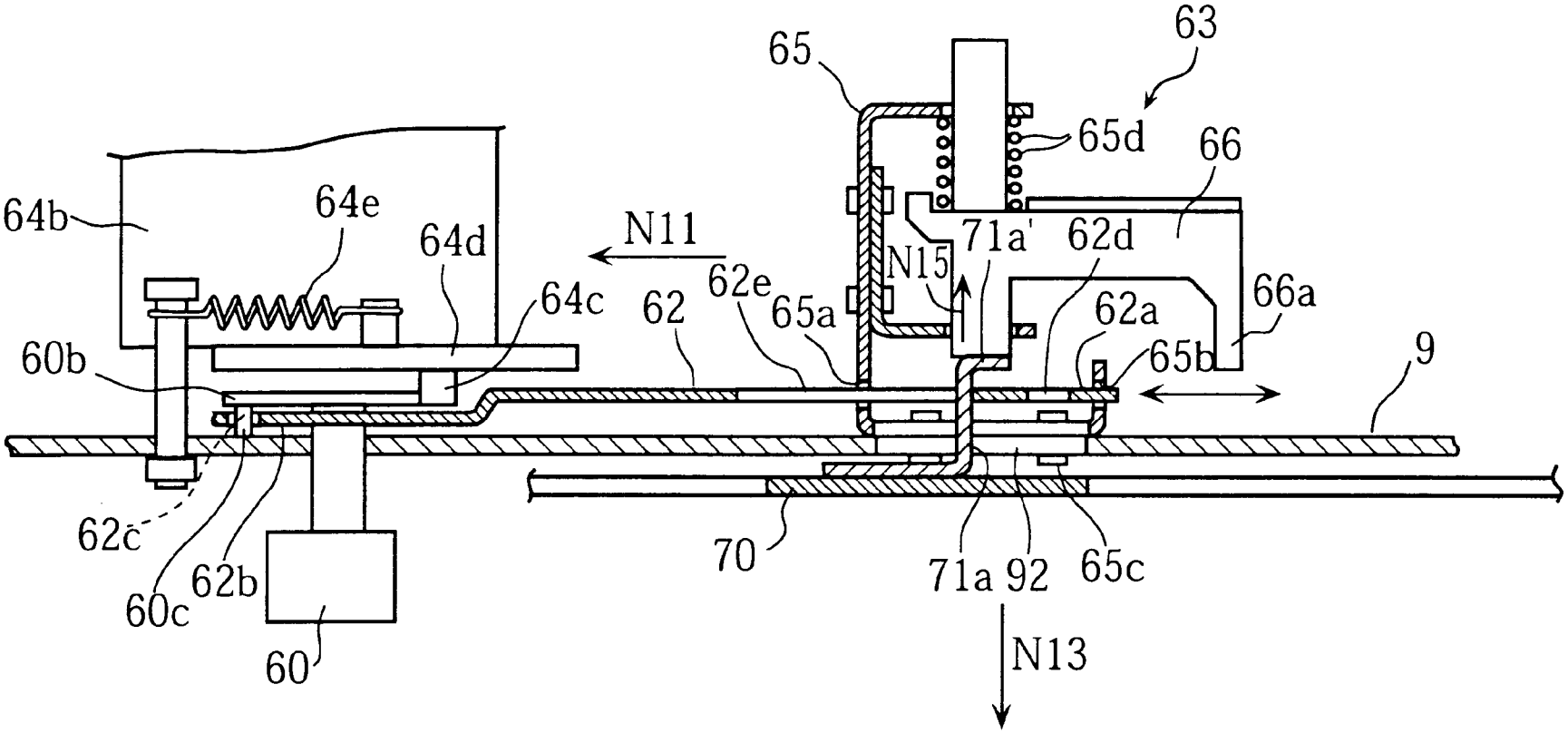
FIG. 31 is a sectional plan view showing the unit and elements of FIG. 30.
Figure 32:
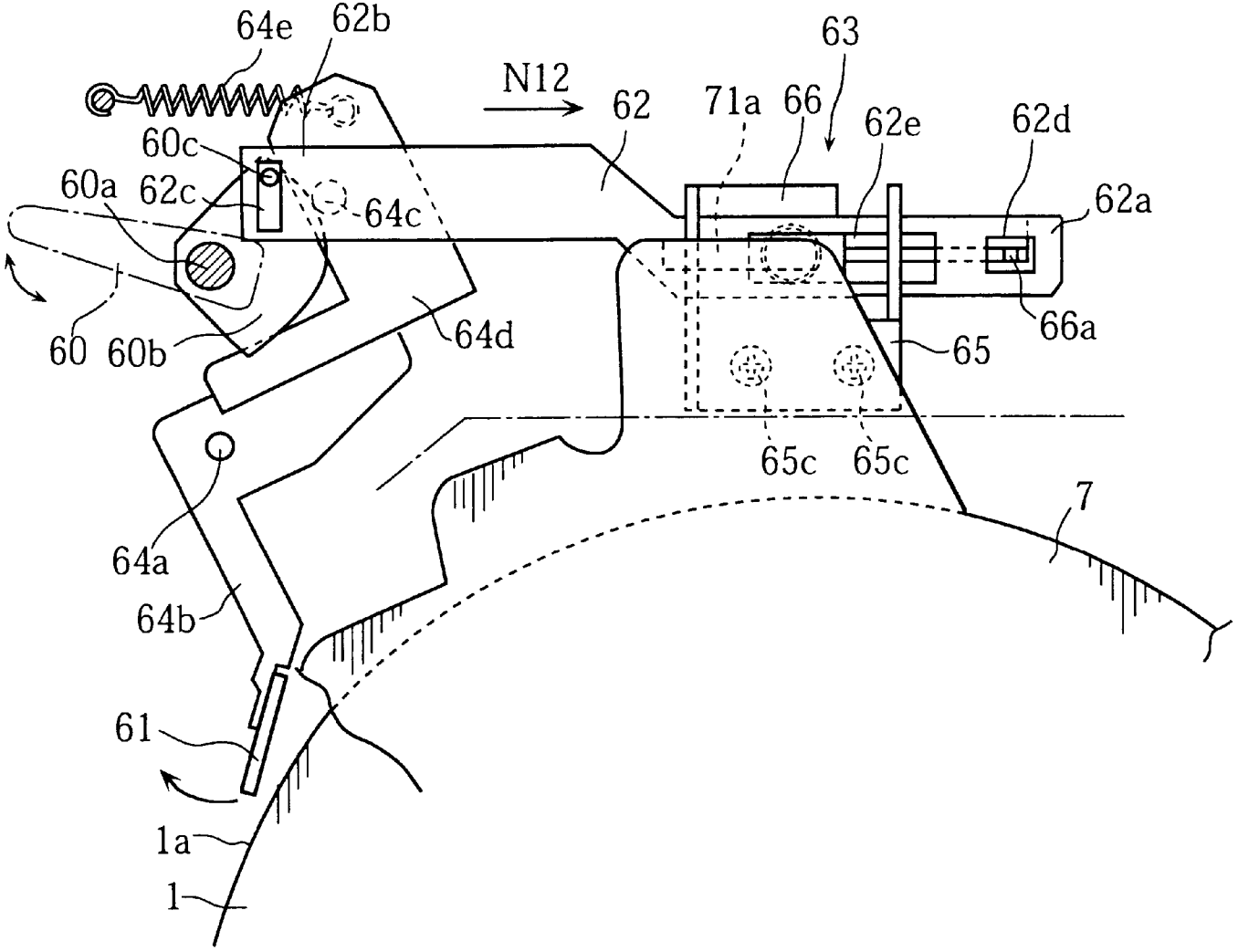
FIG. 32 is a front view showing the cleaning unit shifted in position.
Figure 33:
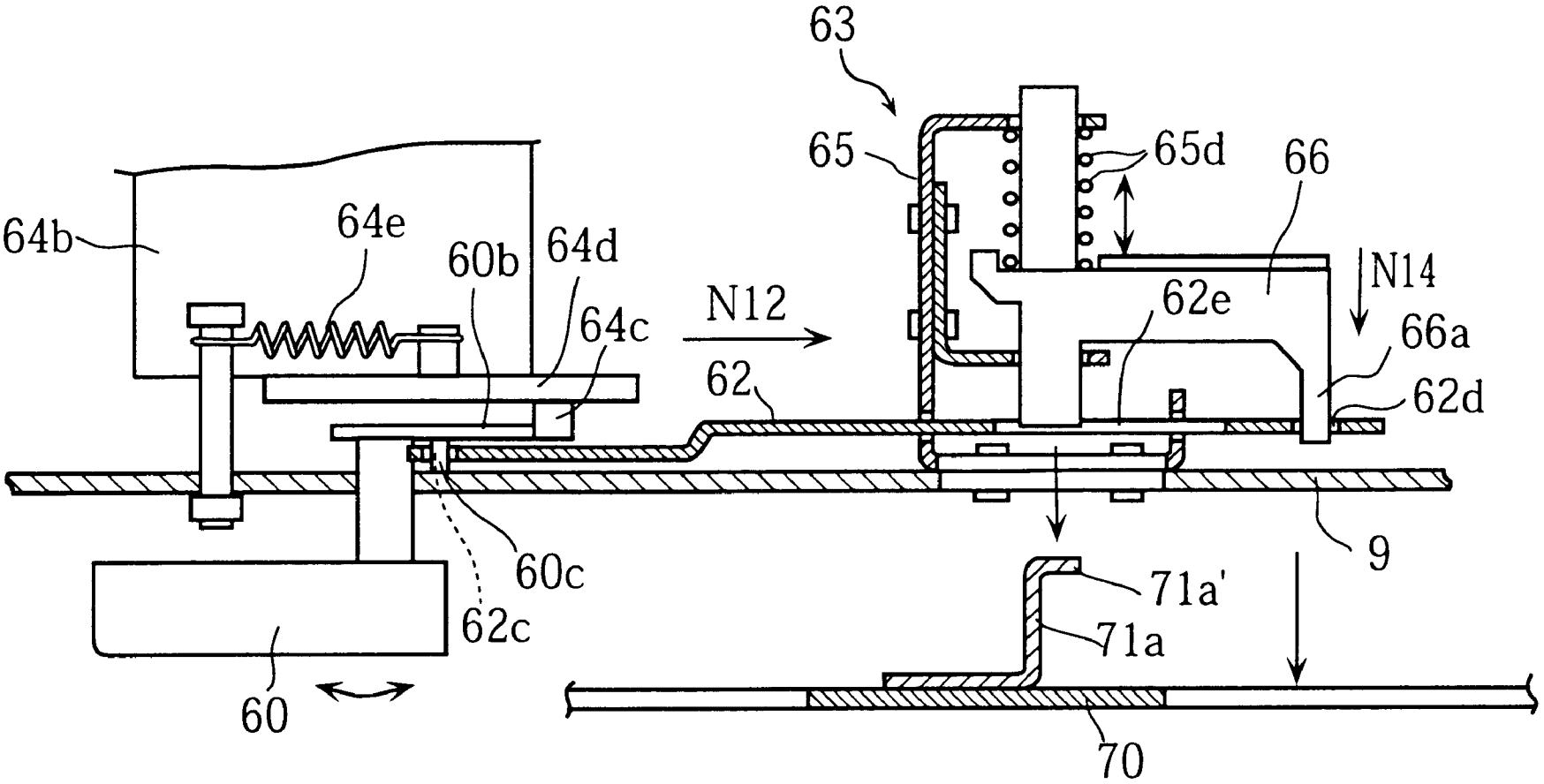
FIG. 33 is a sectional plan view showing the unit and elements of FIG. 32.
Figure 34:
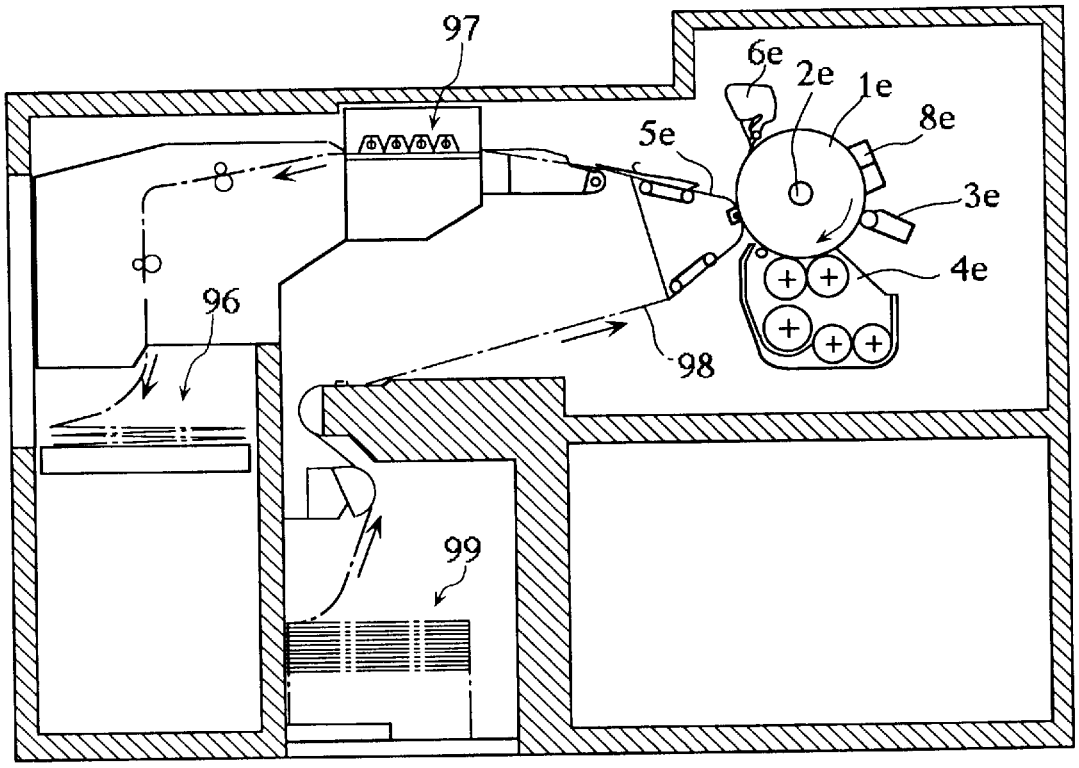
FIG.34 PRIOR ART
FIG. 34 illustrates arrangements of a conventional electrophotographic apparatus.
Figure 35:
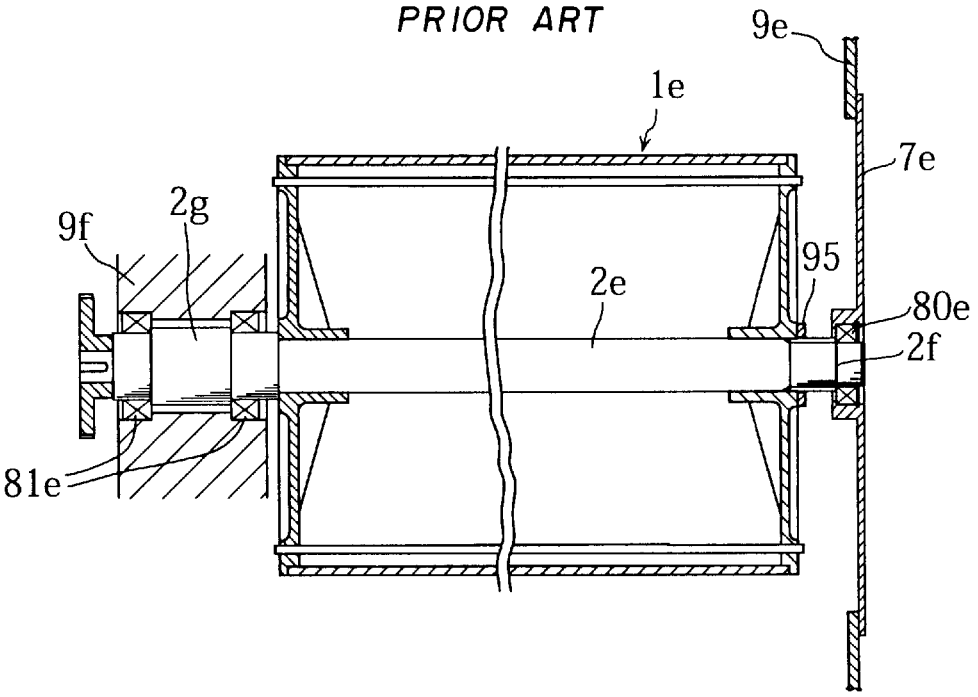
FIG.35 PRIOR ART
FIG. 35 is a sectional view showing fixing arrangements of a photosensitive drum used in the conventional apparatus.
Figure 36:
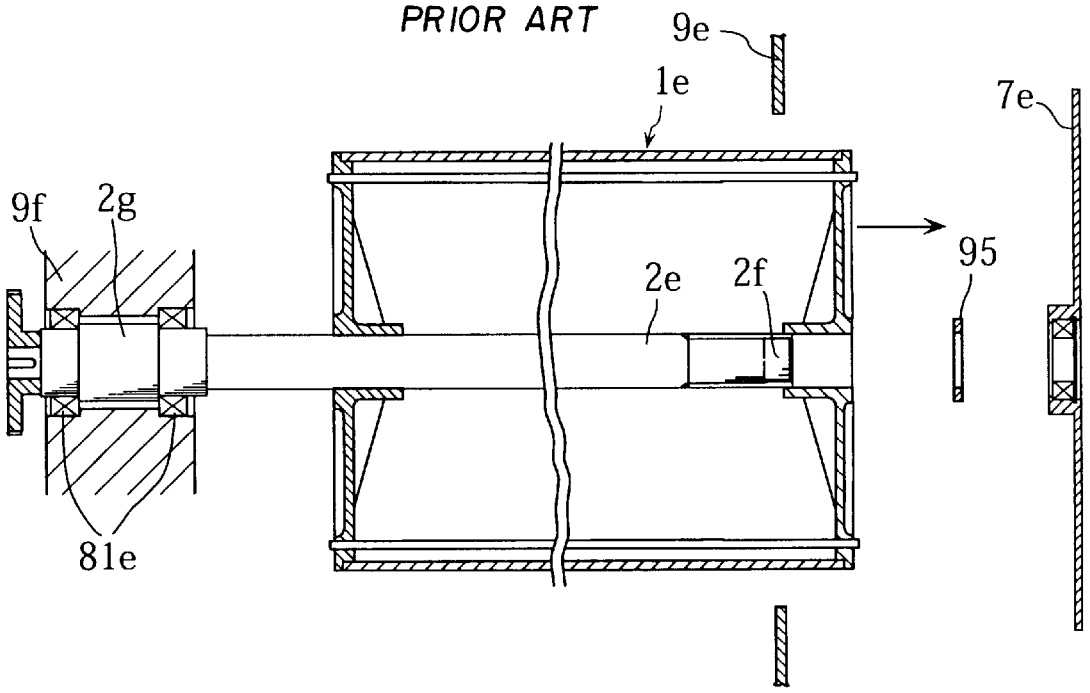
FIG.36 PRIOR ART
FIG. 36 is a sectional view illustrating how the conventional photosensitive drum is removed from a shaft.
Figure 37:
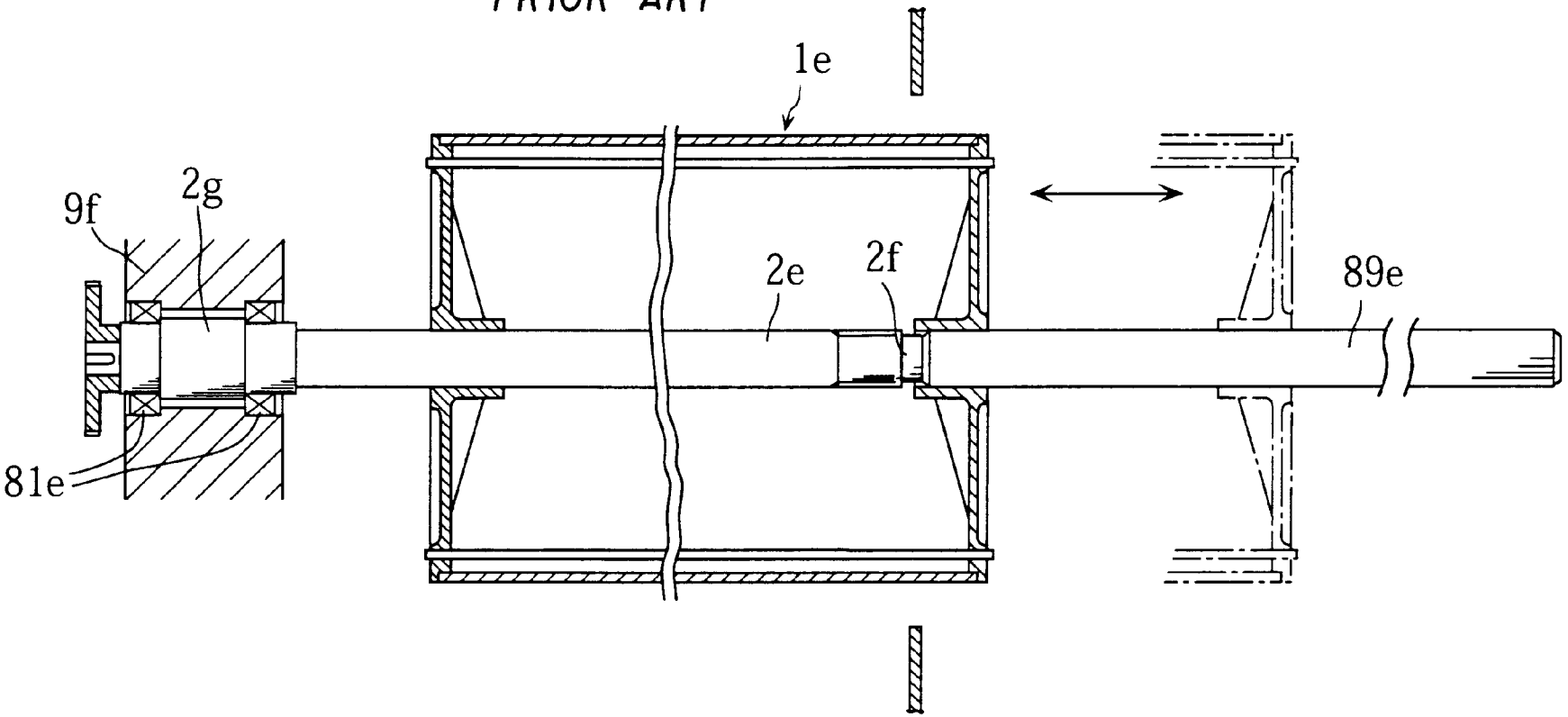
FIG.37 PRIOR ART
FIG. 37 is a sectional view illustrating how the conventional photosensitive drum is moved along the shaft.

FIG. 30 is a front view showing the cleaning unit 6 and relevant elements near the cleaning unit. FIG. 31 is a plan view showing, in section, the components illustrated in FIG. 30. FIG. 32 is a front view showing the cleaning unit 6 at a different position. FIG. 33 is a plan view showing, in section, the components illustrated in FIG. 32.

As shown in FIG. 30, the cleaning unit 6, arranged above the photosensitive drum 1, includes a cleaning blade 61 arranged to come into contact with the outer surface 1*a* of the drum 1. The cleaning blade 61 is movable toward and away from the outer surface 1*a* through the operation of an operation lever 60. Specifically, the cleaning blade 61 is attached to an L-shaped bracket 64*b* pivotable about a stationary shaft 64*a*. The bracket 64*b* is connected to an auxiliary member 64*d* provided with a cam follower 64*c*. The illustrated cam follower 64*c* is a simple, pin-like protrusion. The same may be made up of a rotatable roller for example. The auxiliary member 64*d* is connected to a spring 64*e*. With such an arrangement, the auxiliary member 64*d* and the bracket 64*b* are constantly urged counterclockwise by the spring 64*e*, so that the cleaning blade 61 is held in contact with the outer surface 1*a* of the drum 1. The operation lever 60 is fixed to a rotatably supported shaft 60*a*. Thus, when the operation lever 60 is operated by the user, the shaft 60*a* is rotated about its axis together with the operation lever 60. A fan-shaped cam plate 60*b* is fixed to the shaft 60*a* for guiding the cam follower 64*c* in sliding contact with the cam plate. Thus, upon operation of the operation lever 60, the auxiliary member 64*d* and the bracket 64*b* are caused to pivot about the shaft 64*a*, whereby the cleaning unit 6 is selectively brought into two state, i.e., a set state where the cleaning blade 61 is held in contact with the outer surface 1*a* of the drum 1, and a release state where the cleaning blade is spaced from the outer surface of the drum. In the illustrated cleaning unit 6, unused toner remaining on the outer surface 1*a* is scraped off by the cleaning blade 61 when the cleaning unit 6 is in the set state.

The electrophotographic apparatus A includes a mechanism 63 for restricting the positional change of the cleaning blade 61. As shown in FIG. 30, the restricting mechanism 63 is provided with a movable member 62, a holder 65, and an engaging member 66.

As best shown in FIG. 31, the holder 65 has a rectangular sectional configuration with part of the rectangle missing. The holder 65 is bolted (reference numeral 65*c*) to the chassis 9. The movable member 62 is an elongated plate having a first end 62*a* which is slidably received in two through-holes 65*a*, 65*b* formed in the holder 65. Thus, the movable member 62 can be horizontally reciprocated. As best shown in FIG. 30, the other or second end 62*b* of the movable member 62 is formed with a vertically elongated through-hole 62*c* for slidably receiving a pin 60*c* of the cam plate 60*b*. With such an arrangement, when the operation lever 60 is operated, the pin 60*c* is caused to pivot about the shaft 60*a*, thereby causing the movable member 62 to reciprocate horizontally. More specifically, when the operation lever 60 is brought to a first position shown in FIG. 30 (single-dot chain lines), the movable member 62 is displaced to the left or in an N1-direction. On the other hand, when the operation lever 60 is brought to a second position (release position) shown in FIG. 32, the movable member 62 is displaced to the right or in an N12-direction.

The first end 62*a* of the movable member 62 is formed with a first opening 62*d* and a second opening 62*e*. As will be described in detail later, the first opening 62*d* is provided for receiving an engaging protrusion 66*a* of the engaging member 66. As shown in FIG. 31 for example, the second opening 62*e* is provided for allowing insertion of the extremity 71*a*' (previously described with reference to FIG. 9) of the first engaging member 71*a* of the cover member 7. Similarly, the chassis 9 is formed with an opening 92 for allowing insertion of the extremity 71*a'* of the first engaging member 71*a*. Thus, when the cover member 7 is attached to the fixing means 90, the first engaging member 71*a* extends through the opening 92 of the chassis 9 as well as the second opening 62*e* of the movable member 62. As a result, as shown in FIG. 31, the extremity 71*a'* of the engaging member 71*a* is positioned on a farther side of the movable member 62 as viewed from the cover member 7.

As can be seen from FIG. 31, when the movable member 62 is maximally displaced in the N11-direction, the user cannot remove the first engaging member 71*a* from the second opening 62*e* in an N13-direction, since the extremity 71*a'* is caught by the movable member 62. On the other hand, when the movable member 62 is displaced in the N12-direction, as shown in FIG. 33, the user can remove the first engaging member 71*a* from the opening 62*e*.

The engaging member 66 is supported by the holder 65 in a manner such that the engaging member 66 is movable in a direction perpendicular to the reciprocating direction of the movable member 62. As shown in FIG. 33, the engaging member 66 is constantly urged in an N14-direction by a spring 65*d*. When the engaging member 66 is sufficiently advanced (or moved in the N14-direction) by the spring 65*d*, the engaging member 66 will come into engagement with the movable member 62 displaced in the N12-direction. Specifically, the engaging protrusion 66*a* of the engaging member 66 is received in the first opening 62*d* of the movable member 62. In this way, the movable member 62 is fixed in position by the engaging member 66. On the other hand, as shown in FIG. 31, when the engaging member 66 is caused to retreat in an N15-direction by the first engaging member 71*a* of the cover member 7, the engaging protrusion 66*a* will not interfere with the movable member 62.

In the illustrated apparatus A, as previously stated with reference to FIGS. 30 and 31, when the cleaning unit 6 is in the set state (where the cleaning blade 61 is held in contact with the outer surface 1*a* of the drum 1), it is impossible to remove the cover member 7, let alone the drum 1, from the apparatus A since the extremity 71*a*' of the first engaging member 71*a* is caught by the movable member 62. Thus, in the apparatus A, the user will not unduly remove the drum 1 while the cleaning blade 61 is being held in contact with the outer surface 1*a* of the drum 1. In this way, it is possible to prevent the drum 1 and the cleaning blade 61 from being damaged by each other.

Further, as stated above, when the cover member 7 is attached to the fixing means 90, the first engaging member 71*a* pushes the engaging member 66 away from the movable member 62 to such an extent that the engaging member 66 will not interfere with the movable member 62. Thus, at this stage, the user can bring the cleaning unit 6 into any one of the set state and release state by operating the operation lever 60 (and consequently the movable member 62).

For removing the photosensitive drum 1, the user should bring the cleaning unit 6 into the release state and remove the cover member 7 from the fixing means 90. When the cleaning unit 6 is brought into the release state, the movable member 62 is displaced in the N12-direction as shown in FIG. 33, thereby enabling the user to take the first engaging member 71*a* of the cover member 7 out of the second opening 62*e*. At this stage, the cover member 7 is properly removed. When the cover member 7 is removed, the first engaging member 71*a* does not apply any force to the engaging member 66, whereby the engaging member 66 is advanced in the N14-direction, allowing its engaging protrusion 66*a* to be inserted into the first opening 62*d*. In this condition, the movable member 62 is positionally fixed. As a result, the user cannot operate the operation lever 60 (which is mechanically associated with the movable member 62), so that the cleaning unit 6 is held in the release state. With such an arrangement, it is possible to prevent the cleaning blade 61 from unduly coming into contact with (possibly damaging) the outer surface 1*a* of the drum 1 while the drum 1 is being removed from the shaft 2. At a later time, when the cover member 7 is attached to the fixing means 90 again, the first engaging member 71*a* moves the engaging member 66 away from the movable member 62 (FIG. 31).

At this stage, the user can operate the operation lever 60 for bringing the cleaning unit 6 back into the set state.

The illustrated apparatus A does not include any mechanism for selectively bringing the charging unit 8 into a set state and a release state (in other words, the charging unit 8 is positionally fixed relative to the drum 1). The reason for this is that the charging unit 8 can be installed at a sufficiently remote position from the outer surface 1*a* of the drum 1 without failing to maintain a required level of performance of its function.

The preferred embodiment of the present invention being thus described, it is obvious that the same may be varied in various ways. Such variations should not be regarded as a departure from the spirit and scope of the invention, and all such variations as would be obvious to those skilled in the art are intended to be included within the scope of the appended claims.

I claim:

1. An electrophotographic apparatus comprising:

a photosensitive drum;

a shaft for externally supporting the drum, the drum being removable from and mountable onto the shaft in a sliding manner;

a guide rod releasably connected to the shaft for guiding the drum both in removing the drum from the shaft and in mounting the drum onto the shaft;

a stopper supported by the shaft; and an operation mechanism housed within the shaft for operating the stopper, wherein the operation mechanism causes the stopper to project outwardly of the shaft for coming into engagement with the drum when the guide rod is not connected to the shaft, the operation mechanism also causing the stopper to retreat into the shaft for avoiding engagement with the drum when the guide rod is connected to the shaft.

2. The electrophotographic apparatus according to claim 1, wherein the operation mechanism comprises:

a movable member arranged to reciprocate longitudinally of the shaft, the movable member being associated with the stopper; and a spring connected to the movable member for applying an urging force to the movable member in a predetermined direction;

an end of the shaft being formed with a hollow portion having an opening for allowing insertion of the guide rod, the hollow portion serving to accommodate the movable member and the spring;

said end of the shaft being also formed with a slit communicating with the hollow portion; and wherein the stopper is rotatably supported by the shaft, the stopper being caused to project outwardly of the shaft through the slit when the movable member is displaced toward the opening of the hollow portion, the stopper being caused to retreat into the shaft through the slit when the movable member is displaced away from the opening of the hollow portion.

3. The electrophotographic apparatus according to claim 1, wherein the stopper is arranged to keep projecting outwardly of the shaft when a force directed longitudinally of the shaft is applied to a projecting portion of the stopper.

4. An electrophotographic apparatus comprising:

a photosensitive drum having an end surface;

a cover member for protection of the drum;

fixing means for releasably holding the cover member in facing relation to the end surface of the drum;

a shaft for externally supporting the drum, the shaft has a first end and a second end opposite to the first end, the drum being removable from and mountable onto the shaft in a sliding manner via the first end of the shaft when the cover member is detached from the fixing means;

a presser member supported by the cover member, the presser member being arranged to come into contact with the end surface of the drum when the cover member is brought to the fixing means, so that the presser member moves the drum toward the second end of the shaft; and a presser member operation mechanism for causing the presser member to move away from the drum when the cover member is fixed to the fixing means.

5. The electrophotographic apparatus according to claim 4, further comprising a cover member operation mechanism for selectively bringing the cover member into a set state where the cover member is fixed to the fixing means, and a release state where the cover member is releasable from the fixing means, wherein the presser member operation mechanism serves to move the presser member away from the cover member when the cover member is brought into the release state, while also serving to move the presser member toward the cover member when the cover member is brought into the set state.

6. The electrophotographic apparatus according to claim 5, wherein the cover member operation mechanism includes an operation lever movable between a first position and a second position, and claws supported by the cover member, the claws being arranged to come into engagement with the fixing means when the operation lever is brought to the first position, while also arranged to come out of engagement with the fixing means when the operation lever is brought to the second position, the presser member operation mechanism being arranged to move the presser member toward the cover member when the operation lever is brought to the first position, while also arranged to move the presser member away from the cover member when the operation lever is brought to the second position.

7. An electrophotographic apparatus comprising:

a photosensitive drum having a cylindrical outer surface and an end surface;

a peripheral unit arranged adjacent to the drum, the peripheral unit being selectively brought into a set state where the unit is held closer to the outer surface of the drum and a release state where the unit is held farther from the outer surface of the drum than in the set state;

a cover member releasably held at a setting position in facing relation to the end surface of the drum;

a shaft for externally supporting the drum, the drum being removable from and mountable onto the shaft when the cover member is removed from the setting position; and a cover member restricting mechanism arranged to allow the cover member to be removed from the setting position when the peripheral unit is held in the release state, the restricting mechanism being also arranged to prevent the cover member from being removed from the setting position when the peripheral unit is held in the set state.

8. The electrophotographic apparatus according to claim 7, wherein the peripheral unit comprises a developing unit, the cover member restricting mechanism comprising an engaging portion provided on the developing unit, the engaging portion being arranged to come into engagement with the cover member when the developing unit is held in the set state, the engaging portion being also arranged to come out of engagement with the cover member when the developing unit is held in the release state.

9. The electrophotographic apparatus according to claim 8, further comprising sliding rails for pulling the developing unit out of the electrophotographic apparatus, wherein the developing unit is spaced from the sliding rails when the developing unit is held in the set state, the developing unit being supported by the sliding rails in contact therewith when the developing unit is held in the release state.

10. The electrophotographic apparatus according to claim 7, wherein the peripheral unit comprises an exposing unit, the cover member restricting mechanism comprising an engaging portion provided on the exposing unit, the engaging portion of the exposing unit being arranged to come into engagement with the cover member when the exposing unit is held in the set state, the engaging portion of the exposing unit being also arranged to come out of engagement with the cover member when the exposing unit is held in the release state.

11. The electrophotographic apparatus according to claim 7, wherein the peripheral unit comprises a sheet transferring unit, the cover member restricting mechanism comprising an engaging portion provided on the sheet transferring unit, the engaging portion of the sheet transferring unit being arranged to come into engagement with the cover member when the sheet transferring unit is held in the set state, the engaging portion of the sheet transferring unit being also arranged to come out of engagement with the cover member when the sheet transferring unit is held in the release state.

12. The electrophotographic apparatus according to claim 7, wherein the peripheral unit comprises a cleaning unit provided with a cleaning blade, the cleaning blade being held in contact with the outer surface of the drum when the cleaning unit is in the set state, the cleaning blade being held out of contact with the outer surface of the drum when the cleaning unit is in the release state, the cover member restricting mechanism comprising a movable engaging member which comes into engagement with the cover member when the cleaning unit is held in the set state, the movable engaging member coming out of engagement with the cover member when the cleaning unit is held in the release state.

13. The electrophotographic apparatus according to claim 7, further comprising a peripheral unit restricting mechanism arranged to allow the peripheral unit to be brought into either one of the set and release states when the cover member is held in the setting position, the peripheral unit restricting mechanism being also arranged to cause the peripheral unit to be fixed in the release state when the cover member is removed from the setting position.

14. The electrophotographic apparatus according to claim 13, further comprising: fixing means for holding the cover member in the setting position; and a cover member operation lever for selectively bringing the cover member into a set state where the cover member is fixed to the fixing means and a release state where the cover member is freed from engagement with the fixing means.

15. The electrophotographic apparatus according to claim 14, further comprising a peripheral unit operation lever for selectively bringing the peripheral unit into either one of the set and release states, wherein the peripheral unit comprises a developing unit, the peripheral unit restricting mechanism being arranged to restrict operation of the peripheral unit operation lever when the cover member is brought into the release state.

16. The electrophotographic apparatus according to claim 14, further comprising a peripheral unit operation lever for selectively bringing the peripheral unit into either one of the set and release states, wherein the peripheral unit comprises a cleaning unit having a cleaning blade, the cleaning unit being selectively brought into the set state where the cleaning blade is held in contact with the outer surface of the drum and the release state where the cleaning blade is spaced from the outer surface of the drum, the peripheral unit restricting mechanism being arranged to restrict operation of the peripheral unit operation lever when the cover member is brought into the release state.

17. The electrophotographic apparatus according to claim 14, wherein the peripheral unit comprises an exposing unit arranged to pivot for approaching and moving away from the outer surface of the drum, the peripheral unit restricting mechanism being arranged to allow the exposing unit to perform the pivotal movement when the cover member is attached to the fixing means, the peripheral unit restricting mechanism being also arranged to prevent the exposing unit from approaching the outer surface of the drum beyond a predetermined extent when the cover member is detached from the fixing means.

18. The electrophotographic apparatus according to claim 14, wherein the peripheral unit comprises a sheet transferring unit arranged to pivot for approaching and moving away from the outer surface of the drum, the peripheral unit restricting mechanism being arranged to allow the sheet transferring unit to perform the pivotal movement when the cover member is brought into the set state, the peripheral unit restricting mechanism being also arranged to restrict the pivotal movement of the sheet transferring unit when the cover member is brought into the release state.

* * * * *